US007841393B2

(12) United States Patent
Sekito et al.

(10) Patent No.: US 7,841,393 B2
(45) Date of Patent: Nov. 30, 2010

(54) HEAT EXCHANGER

(75) Inventors: Yasuhiro Sekito, Kariya (JP); Yoshihiko Okumura, Kariya (JP); Toshihiko Muraki, Kariya (JP); Mitsugu Nakamura, Anjo (JP)

(73) Assignee: Denso Corporation, Kariya (JP)

( * ) Notice: Subject to any disclaimer, the term of this patent is extended or adjusted under 35 U.S.C. 154(b) by 459 days.

(21) Appl. No.: 11/888,455

(22) Filed: Aug. 1, 2007

(65) Prior Publication Data

US 2008/0029254 A1 Feb. 7, 2008

(30) Foreign Application Priority Data

Aug. 2, 2006 (JP) ..... 2006-210650
Mar. 8, 2007 (JP) ..... 2007-059086

(51) Int. Cl.
*F28F 9/22* (2006.01)

(52) U.S. Cl. ..... 165/174

(58) Field of Classification Search ..... 165/173, 165/174, 176
See application file for complete search history.

(56) References Cited

U.S. PATENT DOCUMENTS 2,915,294 A * 12/1959 Christensen ..... 165/174
3,196,943 A * 7/1965 Haerter ..... 165/174
3,254,707 A * 6/1966 Ferguson ..... 165/174
4,303,124 A * 12/1981 Hessari ..... 165/174
4,513,587 A * 4/1985 Humpolik et al. ..... 165/174
5,415,223 A * 5/1995 Reavis et al. ..... 165/174
5,465,783 A * 11/1995 O'Connor ..... 165/174
5,806,586 A * 9/1998 Osthues et al. ..... 165/174
7,152,668 B2 * 12/2006 Hoffmann et al. ..... 165/174
2005/0263263 A1 * 12/2005 Merklein et al. ..... 165/76
2008/0023185 A1 * 1/2008 Beamer et al. ..... 165/174
2008/0099191 A1 * 5/2008 Taras et al. ..... 165/174
2008/0289806 A1 * 11/2008 Gorbounov et al. ..... 165/173

FOREIGN PATENT DOCUMENTS

| | | |
|---|---|---|
| GB | 2250336 | 6/1992 |
| JP | 61-18394 | 2/1986 |
| JP | 07-149135 | 6/1995 |
| JP | 09-014885 | 1/1997 |

OTHER PUBLICATIONS

Office Action dated Jan. 9, 2009 in Chinese Application No. 2007 10143723.7.

* cited by examiner

*Primary Examiner*—Leonard R Leo
(74) *Attorney, Agent, or Firm*—Harness, Dickey & Pierce, PLC

(57) ABSTRACT

A heat exchanger has tubes, an inlet tank and an outlet tank. The inlet tank and the outlet tank are coupled to ends of the tubes. The inlet tank and the outlet tank have an inlet port and an outlet port, respectively, on ends thereof. The heat exchanger further has a cover member disposed in at least one of the inlet tank and the outlet tank. The cover member partly covers openings of the ends of predetermined tubes of the tubes, the predetermined tubes being closer to at least one of the inlet port and the outlet port.

16 Claims, 17 Drawing Sheets

HEAT EXCHANGER

CROSS REFERENCE TO RELATED APPLICATION

This application is based on Japanese Patent Applications No. 2006-210650 filed on Aug. 2, 2006 and No. 2007-59086 filed on Mar. 8, 2007, the disclosures of which are incorporated herein by reference.

FIELD OF THE INVENTION

The present invention relates to a heat exchanger.

BACKGROUND OF THE INVENTION

For example, a heat exchanger has a plurality of tubes through which an internal fluid flows, a first tank for distributing the internal fluid into the tubes and a second tank for collecting the internal fluid from the tubes. The inlet tank has an inlet port on its first end and the outlet tank has an outlet port on its first end. The inlet port and the outlet port are disposed on the same side with respect to a tube stacking direction in which the tubes are stacked. Such a heat exchanger is used, for example, as a heating heat exchanger (heater core) for a vehicular air conditioning apparatus.

In the inlet tank of the heat exchanger, pressure loss of the internal fluid (e.g. heated fluid) increases with a distance from the inlet port due to the length of the inlet tank. Therefore, the volumes of the internal fluid flowing into some tubes that are located farther away from the inlet port are smaller than the volumes of the internal fluid flowing into some tubes that are located closer to the inlet port. That is, the volumes of the internal fluid are likely to be uneven between the tubes. With this, distribution of air temperature downstream of the heat exchanger with respect to a flow of air is uneven, resulting in deterioration of air conditioning feeling.

For example, Unexamined Japanese Patent Publication No. 9-14885 discloses a heater core that has a structure for reducing difference of the pressure loss of the internal fluid, such as internal fluid, throughout the inlet tank, thereby to make the volume of the internal fluid substantially uniform between the tubes. In the disclosed heater core, two separation plates are arranged in the inlet tank so that three passages having different length are formed inside of the inlet tank.

The tubes are divided into three groups from the inlet port in the tube stacking direction, and the tubes of each group correspond to each passage. Thus, the internal fluid is substantially uniformly distributed into the tubes from the corresponding passages.

Specifically, a first separation plate and a second separation plate extend in the tube stacking direction, but are spaced from each other in a tube longitudinal direction. The first separation plate is arranged closer to ends of the tubes, and the second separation plate is arranged farther away than the first separation plate with respect to the ends of the tubes. The first separation plate is shorter than the second separation plate, and extends to overlap the tubes of a first group, which is closer to the inlet port, with respect to the tube stacking direction. The second separation plate extends to overlap the tubes of the first group and the tubes of a second group, which is between the first group and a third group, with respect to the tube stacking direction.

Namely, a first passage is defined between the ends of the tubes of the first group and the first separation plate. A second passage is defined between the first separation plate and the second separation plate. A third passage is defined between the second separation plate and a wall of the inlet tank. The first passage is the shortest and the third passage is the longest.

The internal fluid flowing through the first passage is introduced into the tubes of the first group. The internal fluid flowing through the second passage is introduced into the tubes of the second group. The internal fluid flowing through the third passage is introduced into the tubes of the third group.

If the first to third passages have the same flow area (cross-sectional area), the pressure loss of the internal fluid flowing into the tubes of the first group is smaller, and the pressure loss of the internal fluid flowing into the tubes of the third group is larger, due to the differences of the length. In the inlet tank of the disclosed heater core, therefore, the three passages have different cross-sectional areas such that the first passage has the smallest cross-sectional area and the third passage has the largest cross-sectional area.

As such, because the flow speed of the internal fluid in the first passage relatively increases, the pressure loss of the internal fluid flowing into the tubes of the first group increases. Because the flow speed of the internal fluid in the third passage relatively reduces, the pressure loss of the internal fluid flowing into the tubes of the third group reduces.

By this structure, since the pressure loss of the internal fluid flowing into the tubes of the three groups is substantially uniform, the volume of the internal fluid is substantially uniform between the tubes of the three groups. On the other hand, it is necessary to accurately position the separation plates to maintain the respective cross-sectional areas of the three passages. Further, the volumes of the internal fluid in the tubes will be more uniform by increasing the number of the separation plates. However, the structure of the inlet tank becomes complex.

SUMMARY OF THE INVENTION

The present invention is made in view of the foregoing matter, and it is an object of the present invention to provide a heat exchanger having a structure capable of being uniform the volume of internal fluid between tubes.

According to an aspect of the present invention, a heat exchanger includes a plurality of tubes, an inlet tank and an outlet tank. The tubes are stacked in a tube stacking direction. The inlet tank is coupled to the tubes and has an inlet port on an end. The outlet tank is coupled to the tubes and has an outlet port on an end that is on a same side as the inlet port with respect to the tube stacking direction. The heat exchanger further includes a cover member. The cover member is disposed in at least one of the inlet tank and the outlet tank and partly covers openings of ends of predetermined tubes of the plurality of the tubes, the predetermined tubes being located adjacent to at least one of the inlet port and the outlet port with respect to the tube stacking direction.

Since the openings of the ends of the predetermined tubes are partly covered by the cover member, the volumes of internal fluid flowing into the predetermined tubes reduce, so that volumes of the internal fluid flowing into the remaining tubes increase. In other words, the volumes of the internal fluid flowing into the tubes that are closer to the inlet port are reduced, and the volumes of the internal fluid flowing into the remaining tubes, which are relatively farther away from the inlet port, are increased. As such, the volume of the internal fluid in each of the tubes is uniform. Also, the volume of the internal fluid in each tube is uniform by simply partly covering the openings of the ends of the predetermined tubes by the cover member.

According to a second aspect of the present invention, a heat exchanger includes a plurality of tubes stacked in a tube stacking direction and through which an internal fluid flows and an inlet tank coupled to ends of the plurality of tubes. The inlet tank has an inlet port for introducing the internal fluid into the inlet tank. The heat exchanger further includes a cover member disposed in the inlet tank. The cover member contacts the ends of predetermined tubes of the plurality of tubes and partly covers openings of the ends of the predetermined tubes, the predetermined tubes being located adjacent to the inlet port of the inlet tank.

Since the openings of the ends of the predetermined tubes are partly covered by the cover member, the volumes of internal fluid flowing into the predetermined tubes reduce, so that volumes of the internal fluid flowing into the remaining tubes increase. In other words, the volumes of the internal fluid flowing into the tubes that are closer to the inlet port are reduced, and the volumes of the internal fluid flowing into the remaining tubes, which are relatively farther away from the inlet port, are increased. As such, the volume of the internal fluid in each of the tubes is uniform.

BRIEF DESCRIPTION OF THE DRAWINGS

Other objects, features and advantages of the present invention will become more apparent from the following detailed description made with reference to the accompanying drawings, in which like parts are designated by like reference numbers and in which.

DETAILED DESCRIPTION OF EXEMPLARY EMBODIMENTS

First Embodiment

Figure 1:
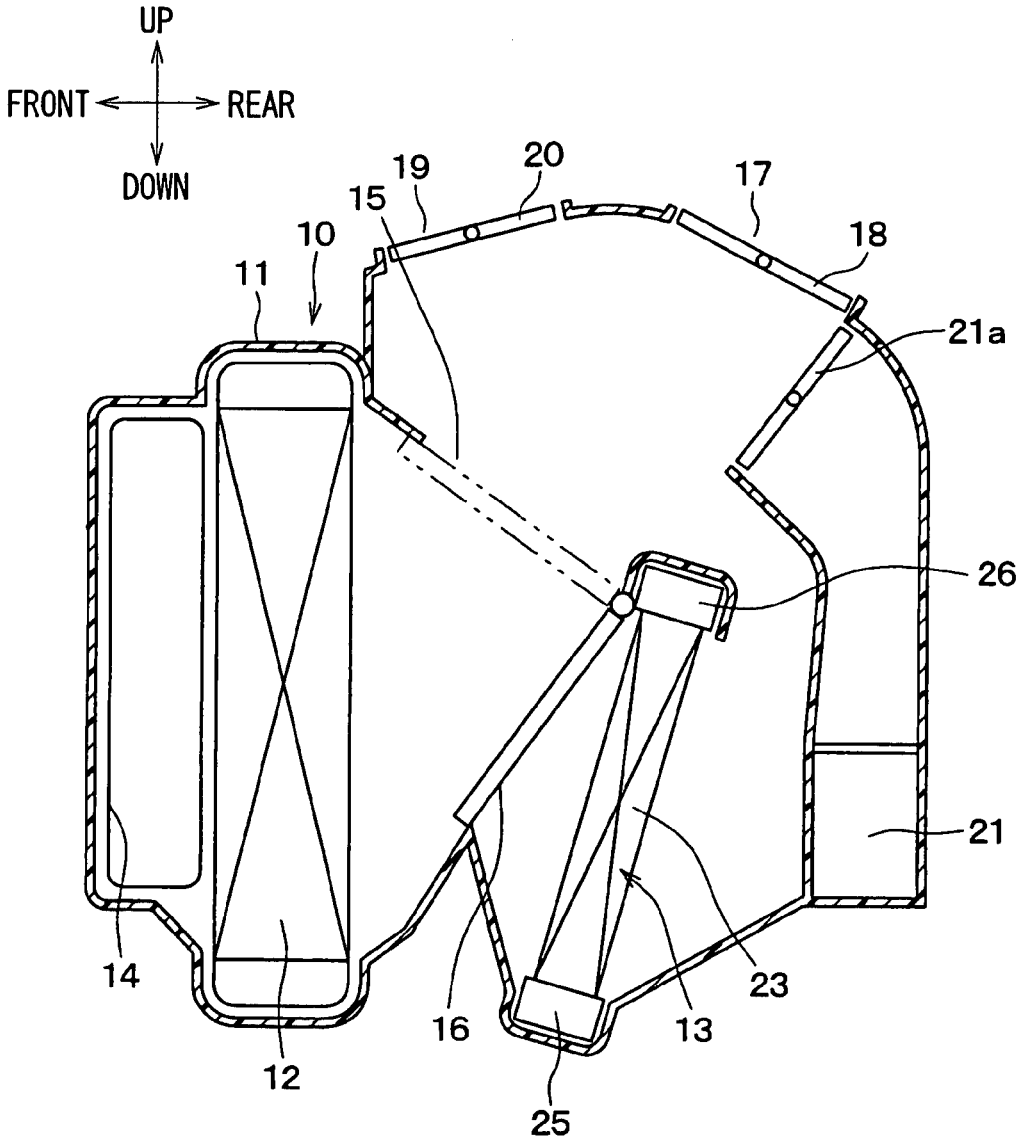
FIG. 1 is a schematic cross-sectional view of an air conditioning unit of a vehicular air conditioning apparatus according to a first embodiment of the present invention.

A first embodiment of the present invention will now be described with reference to FIGS. 1 to 14. FIG. 1 shows an air conditioning unit 10 for a vehicular air conditioning apparatus. In the first embodiment, a heat exchanger is employed as a heating heat exchanger (heater core) 13 of the air conditioning unit 10, for example. In the drawings, an up and down arrow, a front and rear arrow and a left and right arrow denote respective directions when the air conditioning unit 10 is mounted on a vehicle.

The air conditioning apparatus is mounted in a space defined by an instrument panel at a front part of a passenger compartment of a vehicle. Although not illustrated, the air conditioning apparatus has a blower unit for supplying a flow of air toward the air conditioning unit 10. The air conditioning apparatus is for example arranged in a semi-center layout in the space so that the air conditioning unit 10 is mounted in a substantially middle position with respect to a vehicle right and left direction and the blower unit is offset from the air conditioning unit 10 to a side opposite to a driver's seat.

The blower unit generally has an inside/outside air switching box, which selectively draws inside air and outside air as well-known, and an electric centrifugal fan for blowing the air drawn from the inside/outside air switching box toward the air conditioning unit 10.

As shown in FIG. 1, the air conditioning unit 10 generally has an air conditioning case 11, an evaporator 12 and the heater core 13. The evaporator 12 and the heater core 13 are housed in the case 11. The case 11 is made of a resin, such as a polypropylene, having elasticity and strength. For example, the case 11 is constructed by joining plural case members using fastening means such as metal spring clips and screws.

The case 11 has an air inlet port 14 at a front-most portion of a side wall thereof, which faces the blower unit. The case 11 is in communication with the blower unit through the air inlet port 14. Thus, the air blown from the blower unit is introduced into the case 11 through the air inlet port 14.

The evaporator 12 is arranged immediately downstream of the air inlet port 14 with respect to the flow of air in the case 11. Also, the evaporator 12 is arranged such that the air from the blower unit fully passes through the evaporator 12. The evaporator 12 is a cooling heat exchanger that performs heat exchange between the air and an internal fluid such as a refrigerant of a refrigerating cycle, thereby to cool the air.

The heater core 13 is spaced from the evaporator 12, on a rear side of the evaporator 12. Namely, the heater core 13 is arranged downstream of the evaporator with respect to the flow of air. Heated fluid having a high temperature flows inside of the heater core 13, as an internal fluid. The heated fluid is for example an engine cooling water. The heater core 13 is a heated fluid-type heating heat exchanger and heats cooled air, which has been cooled through the evaporator 12, using heat of the internal fluid. In this embodiment, the engine cooling water is LLC (antifreeze liquid), for example.

The case 11 forms a cooled air bypass passage 15 through which the cooled air bypasses the heater core 13, above the heater core 13. An air mixing door 16 having a plate-like shape is arranged immediately downstream of the evaporator 12 with respect to a flow of cooled air, e.g., on the rear side of the evaporator 12. The air mixing door 16 is rotatable so as to adjust the volume of cooled air flowing into the cooled air bypass passage 15 and the volume of cooled air to be introduced toward the heater core 13 for heating. Thus, the temperature of air to be introduced into the passenger compartment is controlled to a desired temperature by adjusting the position of the air mixing door 16.

The case 11 has face openings 17, defroster openings 19 and foot openings 21. The face openings 17 are in communication with face air blowing ports through which air is blown toward upper areas of passenger seats. The defroster openings 19 are in communication with defroster air blowing ports through which air is blown toward a windshield of the vehicle. The foot openings 21 are in communication with foot air blowing ports through which air is blown toward lower areas of passenger seats.

The case 11 has face opening doors 8 for opening and closing the face openings 17, defroster doors 20 for opening and closing the defroster openings 19, and foot doors 21*a* for opening and closing passages communicating with the foot openings 21.

Figure 2:
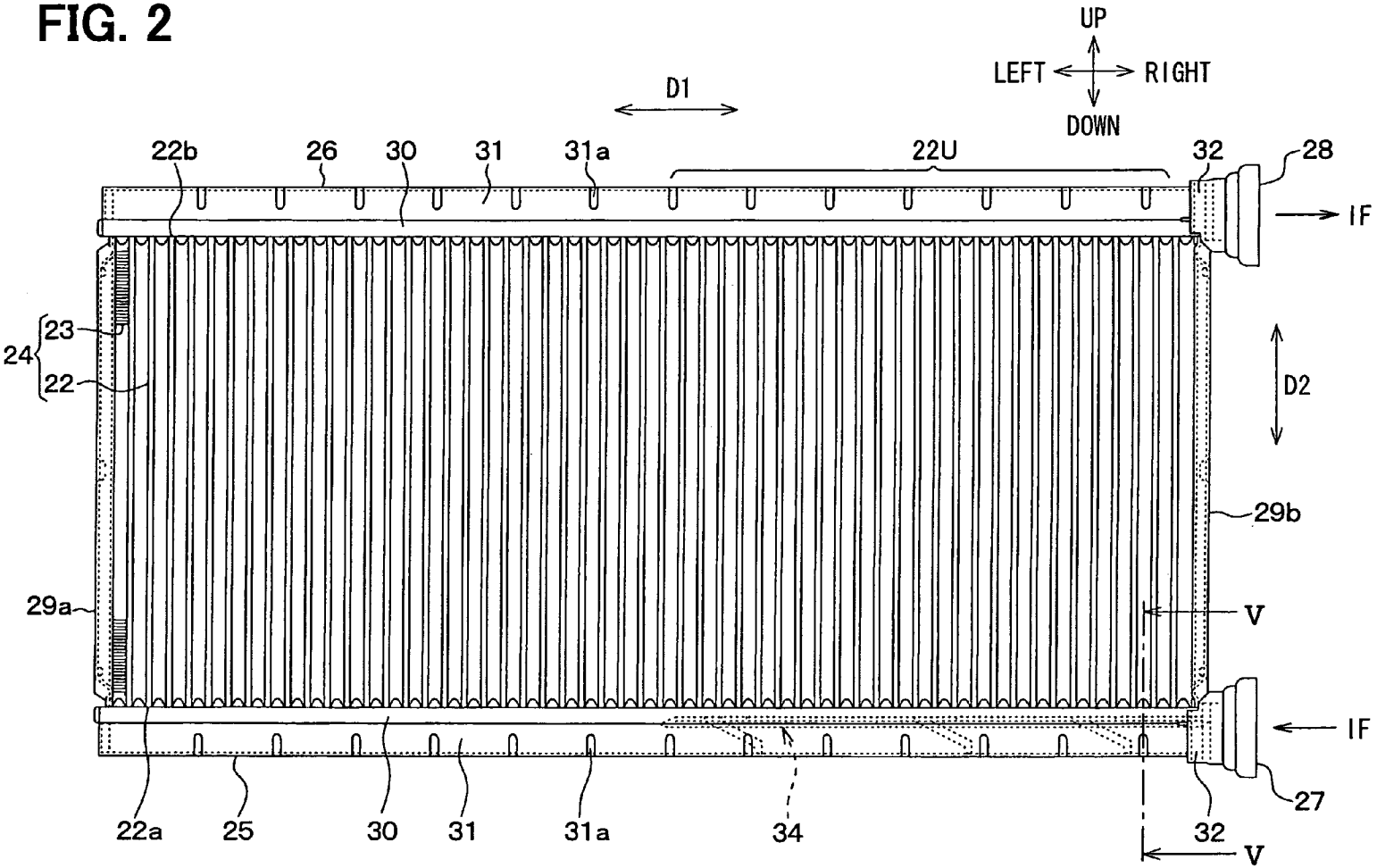
FIG. 2 is a plan view of a heater core of the air conditioning unit according to the first embodiment.

Next, the heater core 13 will be described in more detail with reference to FIGS. 2 to 5. As shown in FIG. 2, the heater core 13 generally has a core part 24 and header tanks such as an inlet tank 25 and an outlet tank 26. The core part 24 includes tubes 22 through which the internal fluid such as the heated fluid flows and corrugated fins 23 disposed between the tubes 22 for facilitating heat exchange between the air and the internal fluid.

The core part 24 has a substantially rectangular outline. Each of the inlet and outlet tanks 25, 26 has a container or box-like shape (e.g., hexahedron). The inlet tank 25 is provided to separate the internal fluid into the tubes 22. The outlet tank 26 is provided to collect the internal fluid having passed through the tubes 22 therein.

The inlet tank 25 is coupled to first ends 22*a* of the tubes 22 and the outlet tank 26 is coupled to second ends 22*b* of the tubes 22. The heater core 13 is arranged such that the inlet tank 25 is located down and the outlet tank 26 is located on top.

The inlet tank 25 has a cylindrical inlet port 27 on an end, such as right end in FIG. 2, for introducing the internal fluid into the heater core 13. The outlet tank 26 has a cylindrical outlet port 28 on an end for discharging the internal fluid, which has been cooled by heat exchange with the air, out of the heater core 13. In the drawings, arrows IF denote a flow of the internal fluid.

The heater core 13 also has inserts 29*a*, 29*b* at the ends of the core part 24 for reinforcing the core part 24. The inserts 29*a*, 29*b* extend in a direction parallel to a longitudinal direction D2 of the tubes 22. The ends of the inserts 29*a*, 29*b* are joined with the inlet and outlet tanks 25, 26.

Each of the inlet and outlet tanks 25, 26 has a core plate (sheet metal) 30, a tank main body (capsule) 31 and a cap 32. The core plate 30 is formed with tube insertion holes 30*a* into which the ends 22*a*, 22*b* of the tubes 22 are inserted. The core plate 30 and the tank main body 31 are joined with each other so that a tank inner space is provided therebetween. The cap 32 is disposed to close the end of the tank 25, 26 to which the inlet port 27 or the outlet port 28 is coupled.

The core plate 30 has a generally rectangular plate shape. The tubes 22 are coupled to the core plate 30 such that the ends 22*a*, 22*b* slightly project from the tube insertion holes 30 toward the tank inner space. Also, the core plate 30 is formed with insertion holes 30*b* for receiving the ends of the inserts 29*a*, 29*b* at the longitudinal ends thereof.

The tank main body 31 has a generally semi-tubular shape. The tank main body 31 is formed by bending ends of a metal plate, such as aluminum plate, substantially perpendicularly, and the bent portions have arc shapes (R-shape). Also, embossed portions 31*a* are formed on the bent portions of the tank main body 31 along the R-shapes so as to restrict spring back during the forming. The embossed portions 31*a* project inside of the tank 25, 26. The embossed portions 31*a* are formed at predetermined intervals in a longitudinal direction of the tank main body 31.

The cap 32 is integrally formed with either the inlet port 27 or the outlet port 28. An end of the tank 25, 26, which is opposite to the cap 32 with respect to the longitudinal direction of the tank 25, 26, is covered by bending a portion of the tank main body 31. The core plate 30, the tank main body 31, the cap 32, the tubes 22, the fins 23 and the inserts 29*a*, 29*b* are made of metal, such as aluminum, and integrally brazed.

Figure 3:
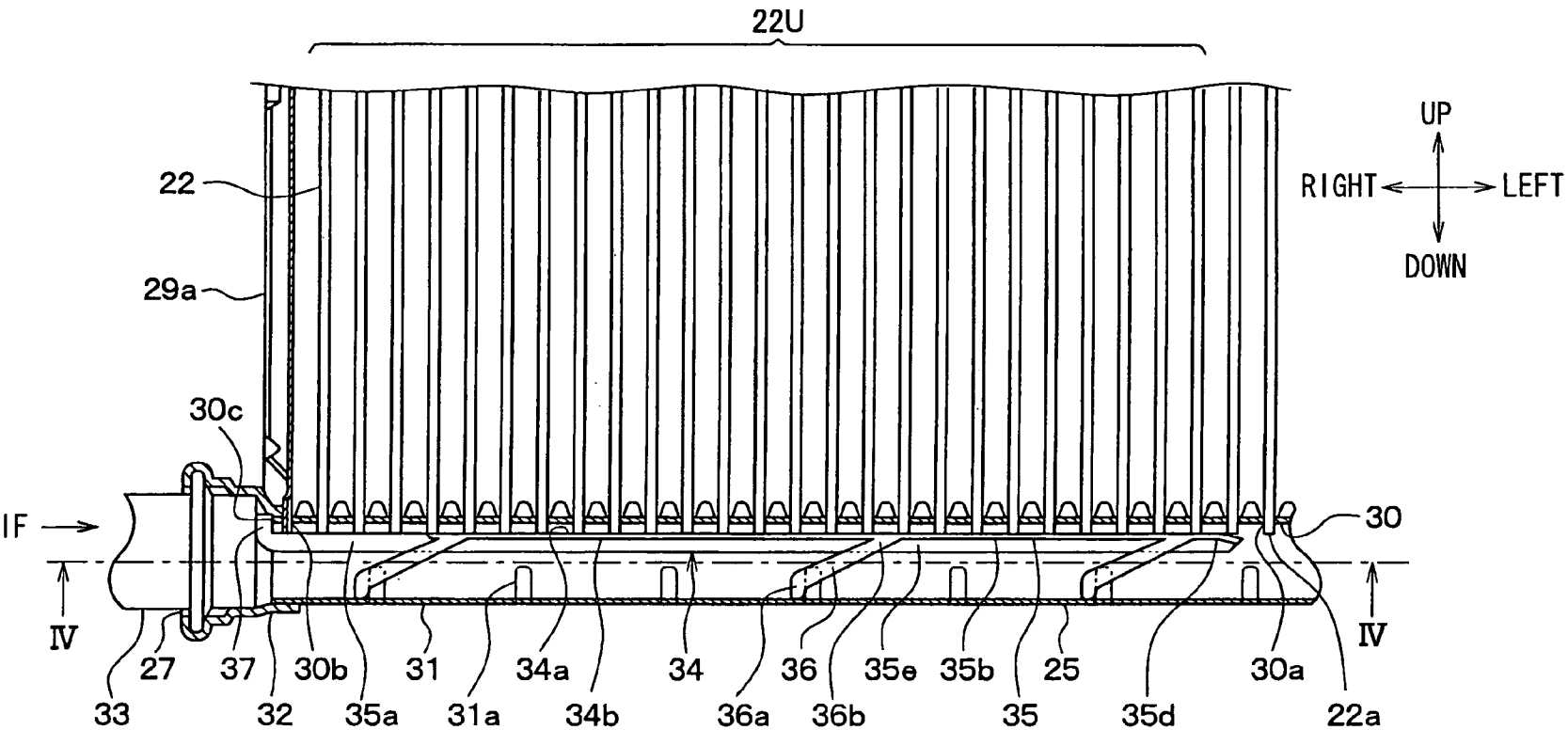
FIG. 3 is an enlarged view of a portion of the heater core, partly in cross-section, according to the first embodiment.

As shown in FIG. 3, an inlet pipe 33 is coupled to the inlet port 27 for introducing the internal fluid into the heater core 13, and an outlet port (not shown) is coupled to the outlet port 28 for discharging the internal fluid, which has exchanged heat with the air, out of the heater core 13. The inlet pipe 33 and the outlet pipe are inserted to and fixed with the inlet port 27 and the outlet port 28 such as by crimping, respectively.

Further, a plate member 34 is provided in the inlet tank 25. The plate member 34 is disposed to correspond to a predetermined number of tubes (hereafter, also referred to as tube group) 22U of the tubes 22. The plate member 34 is disposed to partly cover an opening of the first end (hereafter, inlet end) 22*a* of each of the tubes 22U. Here, the number of the tubes 22U is counted from an end adjacent to the inlet port 27. In this embodiment, the number of the tubes 22U is approximately half of a total number of the tubes 22. Namely, the plate member 34 is disposed to correspond to approximately half of the tubes 22, which are located on a side adjacent to the inlet port 27. The plate member 34 is also referred to as a cover member and the inlet ends 22*a* of the tubes 22U are also referred to as covered ends.

The plate member 34 has a wall surface 34*a* that extends perpendicular to the longitudinal direction of the tubes 22U. The wall surface 34*a* closely contact the inlet ends 22*a* of the tubes 22U. A structure and a shape of the plate member 34 will be described in more detail with reference to FIGS. 3 to 9.

As shown in FIGS. 3 to 7, the plate member 34 has a main wall 35 and leg portions 36 for pressing or biasing the main wall 35 toward the inlet ends 22*a* of the tubes 22U. The main wall 35 has a flat pate shape extending in a tube stacking direction D1 in which the tubes 22 are stacked and having predetermined widths a1, a2, a3. Here, the width a1, a2, a3 of the main wall 35 is define by a dimension measured in a direction perpendicular to the tube stacking direction D1, such as the up and down direction of a paper of FIG. 7. The wall surface 34*a* is provided by a first surface of the main wall 35, which faces the inlet ends 22*a* of the tubes 22U.

The plate member 34 is made of a material that has characteristics such as resistance to the internal fluid (LLC), flexibility for assembling, heat resistance, and small creep deformation. In this embodiment, the plate member 34 is made of polyacetal resin (POM), for example. Alternatively, the plate member 34 may be made of polypropylene (PP), 66 nylon (PA66), polyphenylene sulfide (PPS) or the like. The plate member 34 is for example molded by a mold unit including an upper mold facing the wall surface 34*a* and a lower mold facing a second surface 34*b* of the plate member 34, which is opposite to the wall surface 34*a*.

Figure 7:
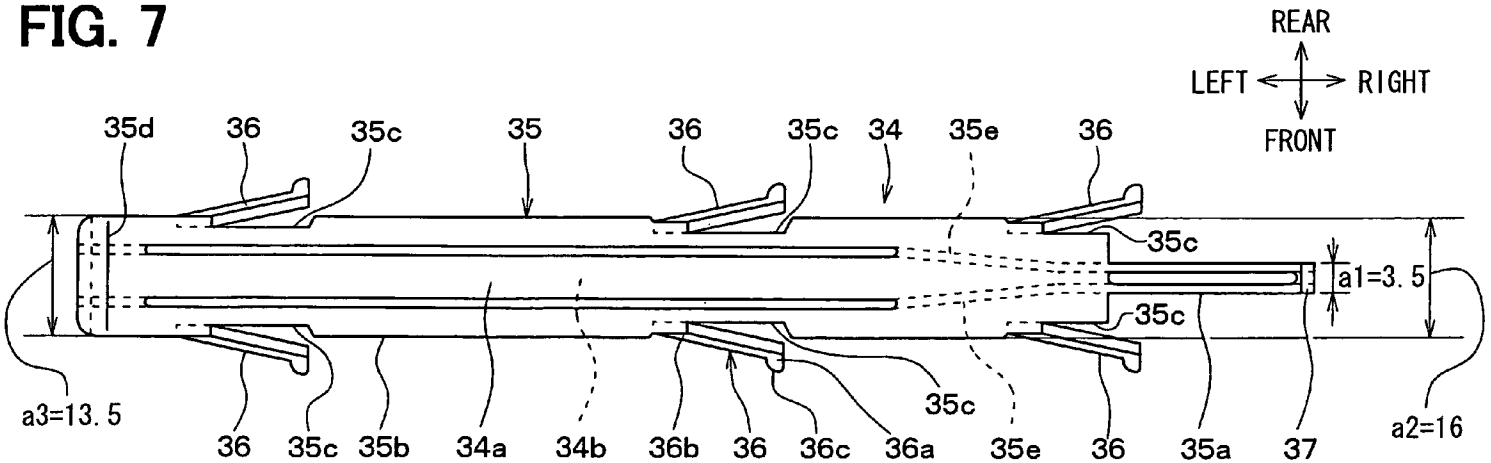
FIG. 7 is a plan view of the plate member according to the first embodiment.

As shown in FIG. 7, the main wall 35 includes a narrow portion 35*a* having the width a1 and a wide portion 35*b* having the widths a2, a3 that are larger than the width a1 of the narrow portion 35*a*. The main wall 35 is disposed such that the narrow portion 35*a* is closer than the wide portion 35*b* with respect to the inlet port 27.

The wide portion 35*b* is formed with notched portions 35*c*. The wide portion 35*b* is tapered in a direction away from the narrow portion 35*a*. Namely, the width of the wide portion 35*b* reduces from its first end toward a second end that is farther away than the first end with respect to the inlet port 27, except for the notched portions 35*c*.

Figure 4:
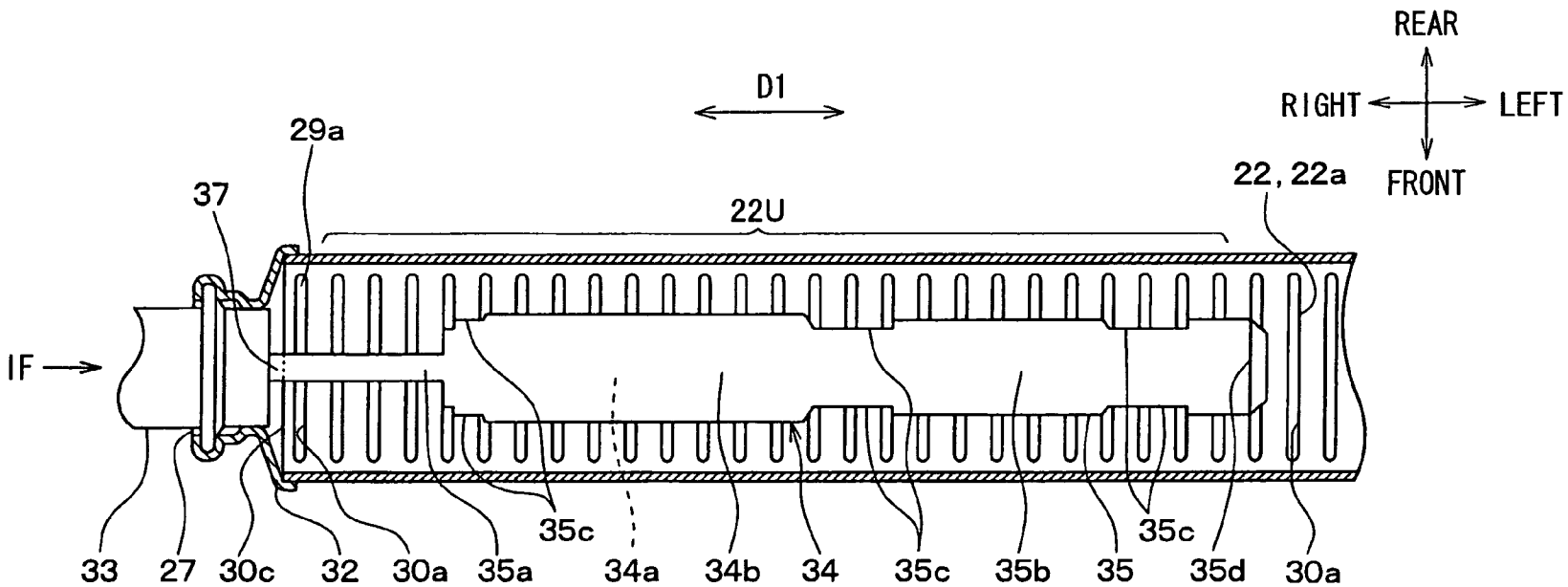
FIG. 4 is a cross-sectional view of the heater core taken along a line IV-IV in FIG. 3.

As shown in FIG. 4, the narrow portion 35*a* is disposed to partly cover the openings of the inlet ends 22*a* of upstream three tubes of the tubes 22U, the three tubes being closer to the inlet port 27. The wide portion 35*b* is disposed to partly cover the openings of the inlet ends 22*a* of the remaining tubes of the tubes 22U.

Figure 8:
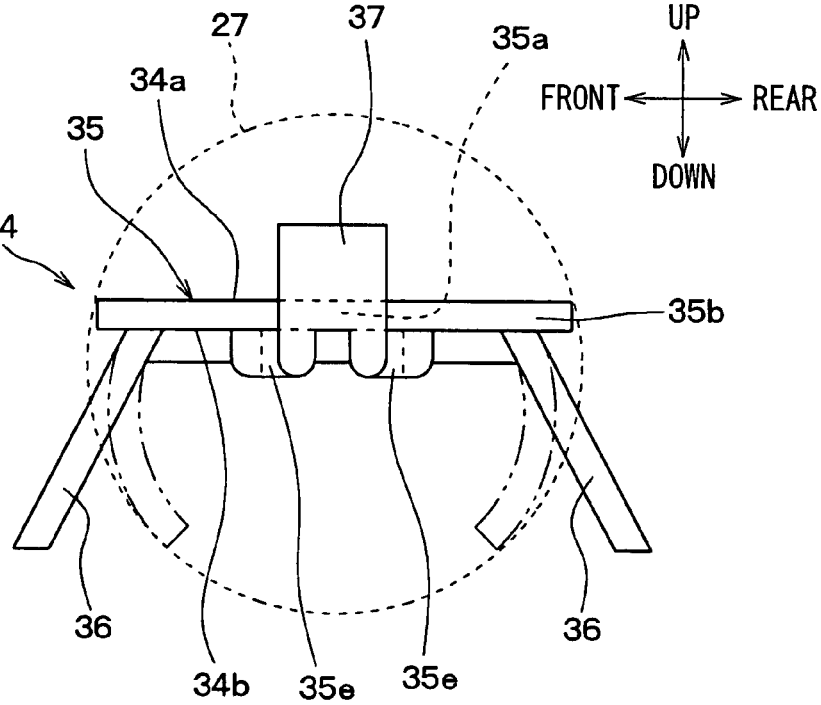
FIG. 8 is an end view of the plate member viewed along an arrow VIII in FIG. 6.

In this embodiment, the width a1 of the narrow portion 35*a* is 3.5 mm. The width a2 of the first end of the wide portion 35*b* is 16 mm. The width a3 of the second end of the wide portion 35*b*, which is farther away than the first end with respect to the narrow portion 35*a*, is 13.5 mm. Also, the widths a1, a2, a3 are smaller than a diameter (opening dimension) of the opening of the inlet port 27, as shown in FIG. 8.

Figure 6:
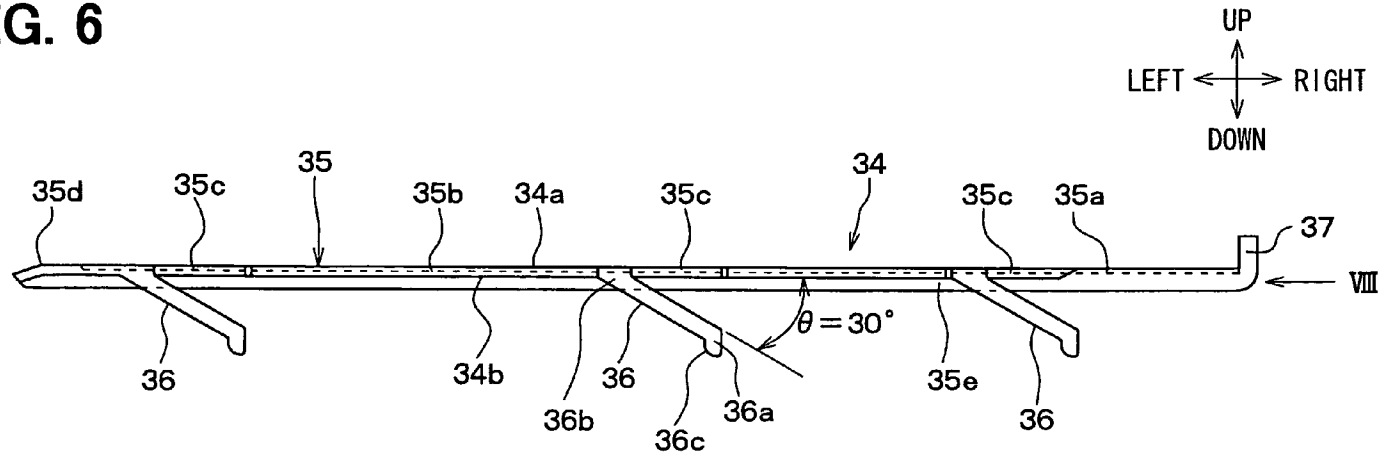
FIG. 6 is a side view of a plate member of the heater core according to the first embodiment.

As shown in FIG. 6, the narrow portion 35*a* has an engagement projection 37 at its end that is adjacent to the inlet pot 27. The engagement projection 37 projects toward the core plate 30 for engaging with an end surface 30*c* of the core plate 27 in the tube stacking direction D1, the end surface 30*c* being adjacent to the inlet port 27, as shown in FIG. 3.

Also, the second end of the wide portion 35*b* has a curved portion 35*d*. The curved portion 35*d* has surface that is inclined relative to the wall surface 34*a* so that a distance between itself and the inlet ends 22*a* of the tubes 22U increases toward its distal end.

The plate member 34 is formed with two ribs 35*e* on the second surface 34*b* for improving the rigidity of the main wall 35. The ribs 35*e* project from the second surface 34*b* and extends across the length of the main wall 35.

Figure 5:
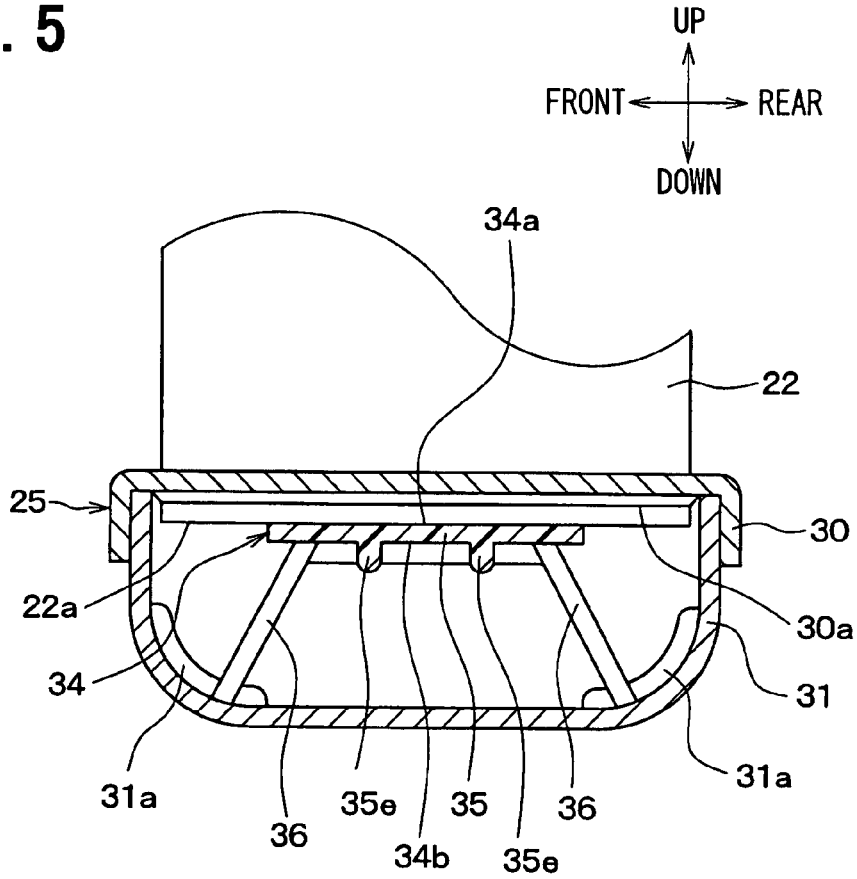
FIG. 5 is a cross-sectional view of the heater core taken along a line V-V in FIG. 2.

The leg portions 36 extend from side ends of the main wall 35 toward the embossed portions 31*a* of the main body 31, the side ends extending in the longitudinal direction of the main wall 35. For example, three leg portions 36 are formed in each of the side ends of the main wall 35 in the longitudinal direction of the header tank 25, 26. When the plate member 34 is viewed from its end, the leg portions 36 form a substantially V-shape, as shown in FIG. 5.

Also, the leg portions 36 extend in a direction that is inclined toward the inlet port 27 relative to the longitudinal direction D2 of the tubes 22, as shown in FIG. 6. Namely, the leg portions 36 are inclined such that an end 36*a* of each leg portion 36 is closer to the inlet port 27 than a base portion 36*b* thereof.

In this embodiment, when the plate member 34 is viewed in a direction perpendicular to the longitudinal direction thereof as shown in FIG. 6, an angle θ of inclination of each leg portion 36 relative to the wall surface 34*a* or the second surface 34*b* is 30°.

The end 36*a* of each leg portion 36 includes a bent portion that extends in a direction parallel to the longitudinal direction D2 of the tubes 22. The bent portion is configured to engage with the embossed portion 31*a* of the tank main body 31 in the tube stacking direction D1. Namely, the end 36*a* has a corner portion 36*c* having an arc shape (R-shape). The corner portion 36*c* projects toward the embossed portion 31*a* of the main body 31 of the tank 25, 26.

The notched portions 35*c* are formed on the main wall 35 at positions corresponding to the leg portions 36. In FIG. 6, the notched portions 35*c* are formed above the leg portions 36. Since the notched portions 35*c* are formed, the upper mold and the lower mold can be removed from the molded plate member 34 in a mold opening direction, such as the up and down direction in FIG. 6, when the plate member 34 is formed.

Next, an assembling procedure of the plate member 34 to the inlet tank 25 will be described. First, the components of the heater core 13 other than the plate member 34 are integrally brazed. Then, the plate member 34 is inserted into the inlet tank 25 from the opening of the inlet port 27 in a direction parallel to the tube stacking direction D1.

FIG. 8 shows a condition of the plate member 34 when the plate member 34 is being inserted into the inlet tank 25 from the inlet port 27. As described in the above, the widths a1, a2, a3 of the main wall 35 are smaller than the inner diameter of the opening of the inlet port 27. Thus, as shown by dashed line in FIG. 8, the main wall 35 can pass through the opening of the inlet port 27.

Further, as shown by double-dashed chain lines in FIG. 8, the leg portions 36 of the plate member 34 are elastically deformed along an inner surface of the inlet port 27 when the plate member 34 passes through the inlet port 27. Therefore, the plate member 34 can be inserted into the inlet tank 25 through the inlet port 27 in the tube stacking direction D1.

The plate member 34 is inserted up to a position where the engagement projection 37 engages the end surface 30*c* of the core plate 30. Since the main wall 35 has the inclined surface 35*d* at the second end, and the inclined surface 35*d* is inclined in the direction opposite to the inlet ends 22*a* of the tubes 22U, the main wall 35 is smoothly inserted into the inlet tank 25 without crushing the inlet ends 22*a* of the tubes 22U due to collisions.

The leg portions 36 are inclined in a direction opposite to an inserting direction of the plate member 34. Therefore, interference between the leg potions 36 and the tank 26 is reduced when the plate member 34 is inserted in the inlet tank 25. Accordingly, the plate member 34 is smoothly inserted into the inlet tank 25.

Since the ends 36*a* of the leg portions 36 have the arc-shaped corner portions 36*c*, the leg portions 36 can move over the embossed portions 31*a* of the tank main body 31 while being elastically deformed, when the plate member 34 is inserted into the inlet tank 25. Thus, the plate member 34 is inserted to the predetermined position in the inlet tank 25 in the tube stacking direction.

When the plate member 34 is inserted to the predetermined position within the inlet tank 25, the bent portions of the ends 36*a* of the leg portions are engaged with the embossed portions 31*a* in the tube stacking direction D1.

Figure 9:
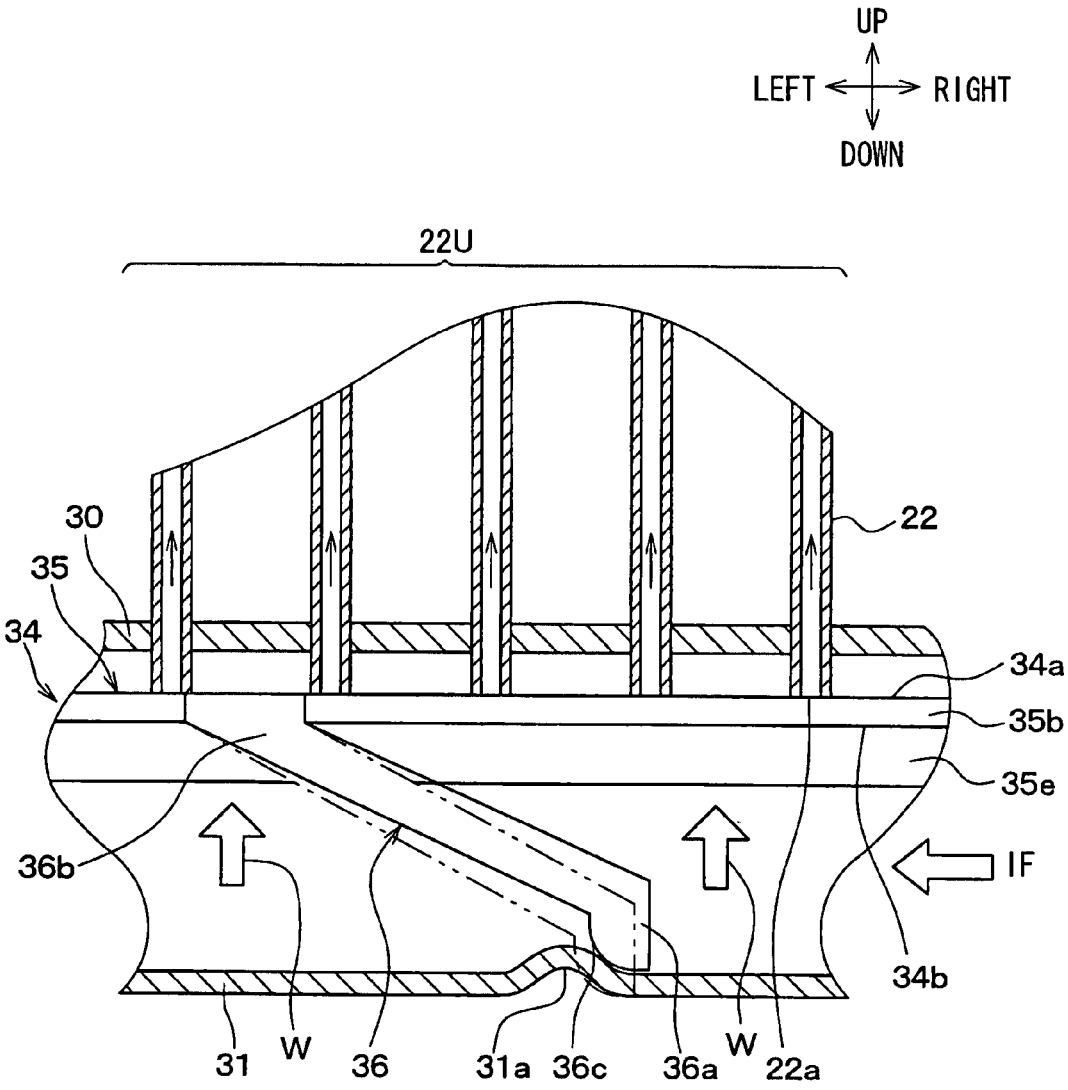
FIG. 9 is an enlarged cross-sectional view of a portion of the heater core, in a condition that leg portions of the plate member are elastically deformed, according to the first embodiment.

In a condition that the plate member 34 has been inserted to the predetermined position within the inlet tank 25, the leg portion 36 is in a position shown by a solid line in FIG. 9. In FIG. 9, a double-dashed chain line shows a position of the leg portion 36 relative to the main wall 35 before the plate member 34 is inserted in the inlet tank 25.

When the plate member 34 is in the predetermined position within the inlet tank 25, the leg portion 36 contacts the embossed portion 31*a* and is elastically deformed. Because the main wall 35 is biased toward the inlet ends 22*a* of the tubes 22U due to elasticity of the leg portion 36, the wall surface 34*a* of the plate member 34 closely contacts the inlet ends 22*a* of the tubes 22U.

Then, when the inlet pipe 33 is fixed to the inlet port 27 by crimping and the like, the engagement projection 37 of the plate member 34 is interposed between an end surface of the pipe 33 and the end surface 30*c* of the core plate 30. As such, the plate member 34 is fixed in the predetermined position within the inlet tank 25 with respect to the tube stacking direction D1.

Next, an operation of the embodiment will be described. The internal fluid is introduced into the inlet tank 25 from the inlet pipe 33 and separated into the tubes 22. Since the openings of the inlet ends 22*a* of the tubes 22U are partly covered by the plate member 34, the volume of the internal fluid flowing into the tubes 22U is reduced. On the other hand, the volume of the internal fluid flowing into the remaining tubes 22, which are farther from the inlet port 27, increases. As such, the volume of the internal fluid flowing into each tube 22 is uniform.

The plate member 34 is pressed against the inlet ends 22*a* of the tubes 22U due to the elasticity of the leg portions 36. Moreover, the plate member 34 is pressed against the inlet ends 22*a* of the tubes 22U due to fluid pressure (dynamic pressure) of the internal fluid flowing into the tubes 22U, as shown by arrows W in FIG. 9.

Accordingly, since the wall surface 34*a* of the plate member 34 closely contacts the inlet ends 22*a* of the tubes 22U, the openings of the inlet ends 22*a* of the tubes 22U are effectively partly covered by the plate member 34. Thus, the volume of the internal fluid between the tubes 22 is uniform.

Figure 10:
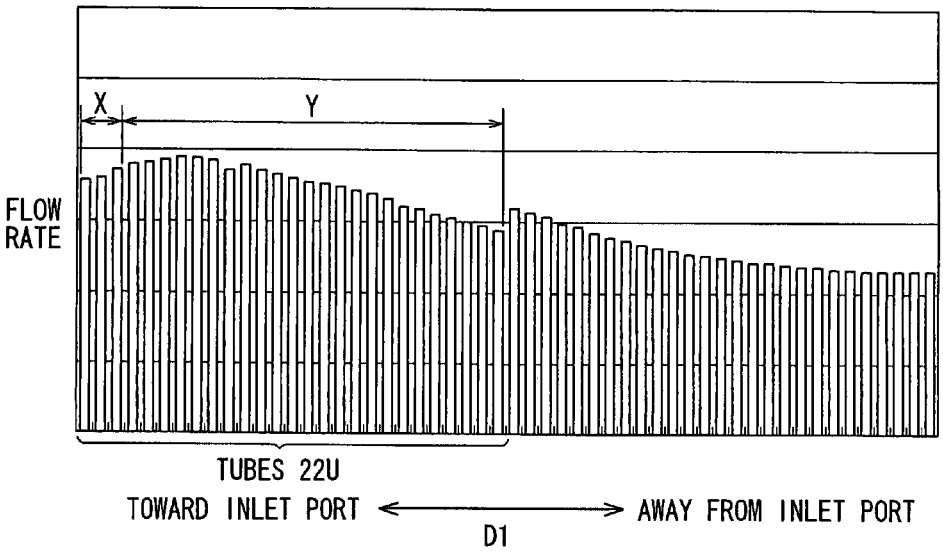
FIG. 10 is a graph showing a flow rate of an internal fluid flowing in each tube of the heater core according to the first embodiment.
Figure 11:
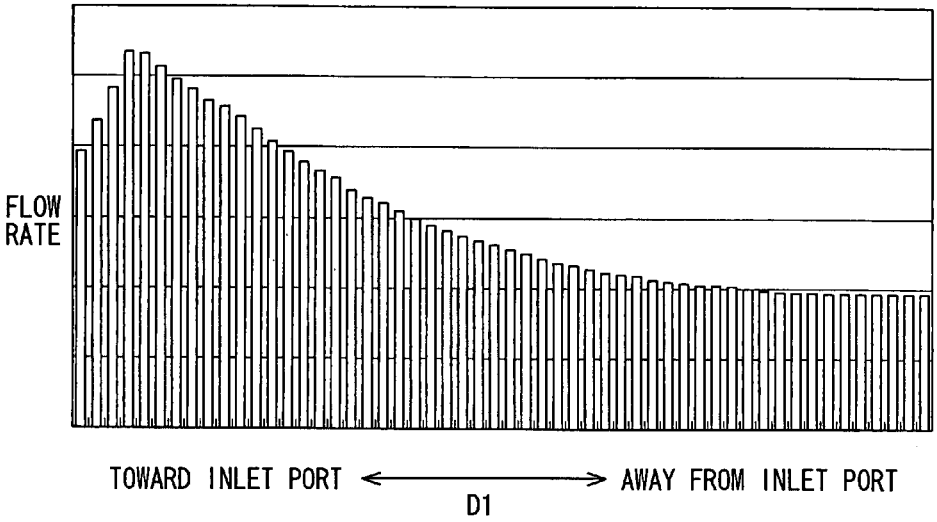
FIG. 11 is a graph showing a flow rate of the internal fluid flowing in each tube of a heater core of a comparative example.

FIGS. 10 and 11 show the results of numerical analysis. FIG. 10 shows the volume (flow rate) of the internal fluid flowing in each of the tubes 22 of the heater core 13 of this embodiment. FIG. 11 shows the volume (flow rate) of the internal fluid flowing in each of tubes of a heater core that does not have the plate member 34 as a comparative example. It is analyzed in a condition that the temperature of suction air is 5° C.; the temperature of the internal fluid flowing into the heater core (hereafter, the internal fluid temperature) is 88° C.; the density of LLC is 50%; the volume of the air is 300 $m^3$/h; and the volume of the internal fluid flowing into the heater core (hereafter, the flow rate FR) is 6 L/min.

In the comparative example without having the plate member 34, as shown in FIG. 11, the volumes of the internal fluid flowing into the tubes that are closer to the inlet port are larger than the volumes of the internal fluid flowing into the tubes that are farther away from the inlet port. That is, the volume of the internal fluid flowing into each tube reduces with a distance from the inlet port. The volume of the internal fluid is uneven between the tubes.

On the other hand, in the first embodiment shown in FIG. 10, the volumes of the internal fluid flowing into the tubes 22U that are closer to the inlet port 27 and are covered by the plate member 34 are reduced, and hence the volumes of the internal fluid flowing into the remaining tubes that are farther away from the inlet port 27 increases. As such, the volume of the internal fluid between the tubes 22 is uniform, as compared with the comparative example shown in FIG. 11.

Also, it is found as a result of the numeral analysis that, if the openings of the inlet tubes 22*a* of the tubes 22U are equally closed, the volume of the internal fluid flowing into the upstream three tubes of the tubes 22U is largely reduced. Thus, the volume of the internal fluid is uneven between the tubes 22U.

In this embodiment, the plate member 34 is disposed such that the narrow portion 35*a* corresponds to the inlet ends 22*a* of the upstream three tubes X of the tubes 22U and the wide portion 35*b* corresponds to the inlet ends 22*a* of the remaining tubes Y of the tubes 22U. That is, in the upstream three tubes X of the tubes 22U, an area covered by the plate member 34 is smaller than that of the remaining tubes Y of the tubes 22U. Therefore, it is less likely that the volumes of the internal fluid flowing into the upstream three tubes X will be reduced largely.

Further, the wide portion 35*b* has the tapered shape such that the width of the wide portion 35*b* other than the notched portions 35*b* reduces toward its second end that is farther away than the first end with respect to the inlet port 27. Therefore, regarding the tubes Y of the tubes 22U, the area covered by the wide portion 35*b* reduces with the distance from the inlet port 27. As such, the effect of reducing the volume of the internal fluid by the wide portion 35*b* reduces from the first end of the wide portion 35*b*, on which the pressure loss is small, toward the second end of the wide portion 35*b*, on which the pressure loss is larger than the first end.

Accordingly, it is less likely that the volumes of the internal fluid flowing into the tubes 22U will be abruptly reduced with the distance from the inlet port 27. According to the above advantageous effects, the volume of the internal fluid in each tube 22 is uniform.

Figure 12:
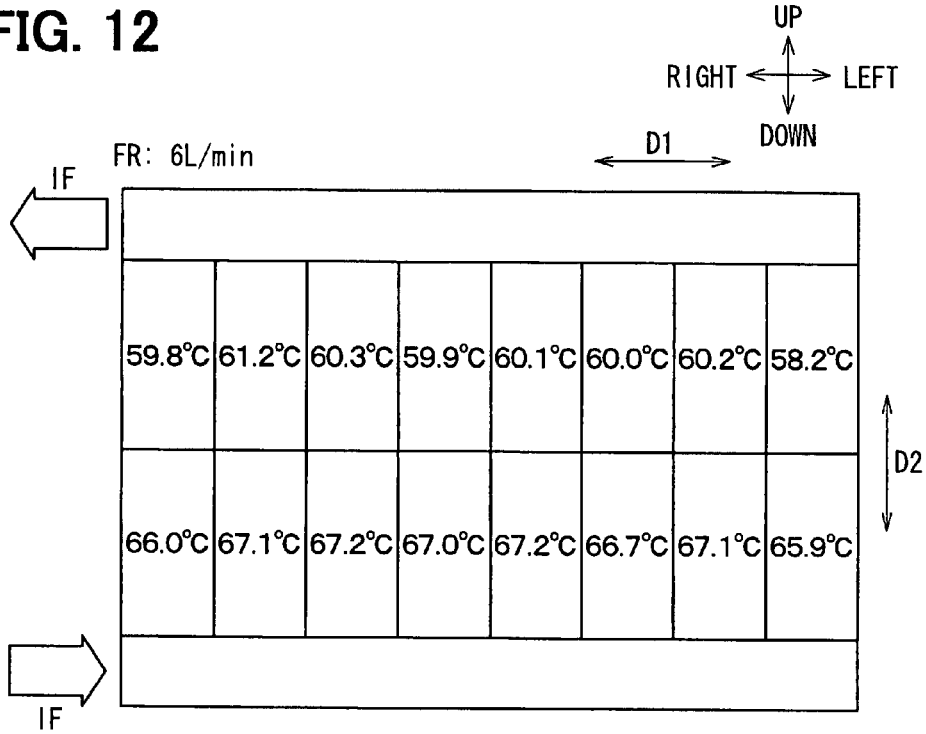
FIG. 12 is a diagram showing a detected temperature of air discharged from each section of the heater core, when a flow rate of an internal fluid is 6 L/min, according to the first embodiment.
Figure 13:
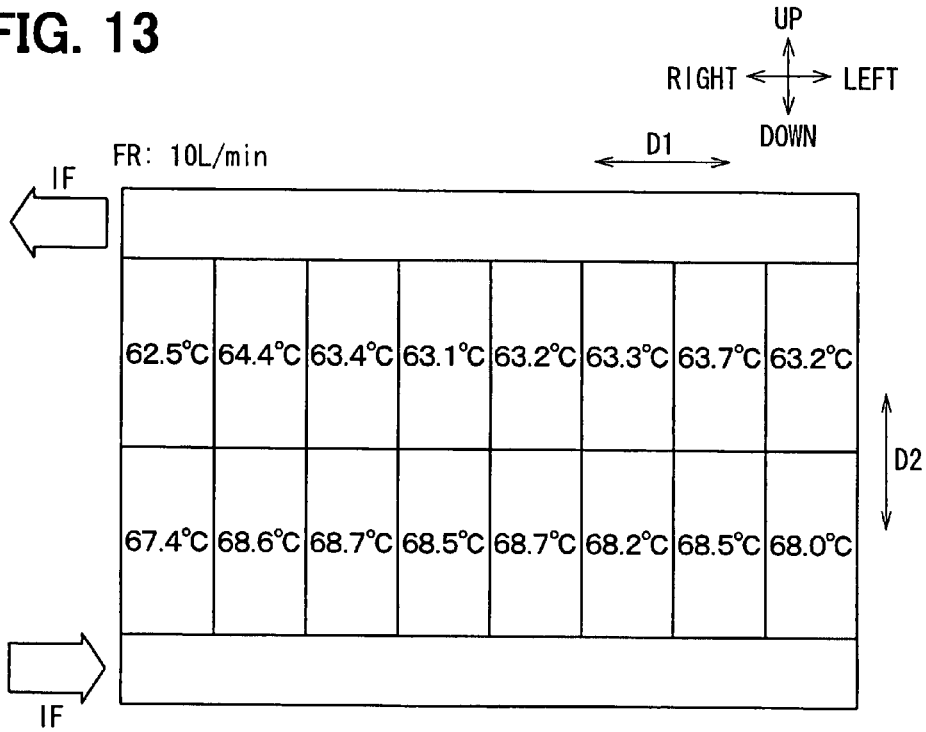
FIG. 13 is a diagram showing a detected temperature of air discharged from each section of the heater core, when the flow rate is 10 L/min, according to the first embodiment.
Figure 14:
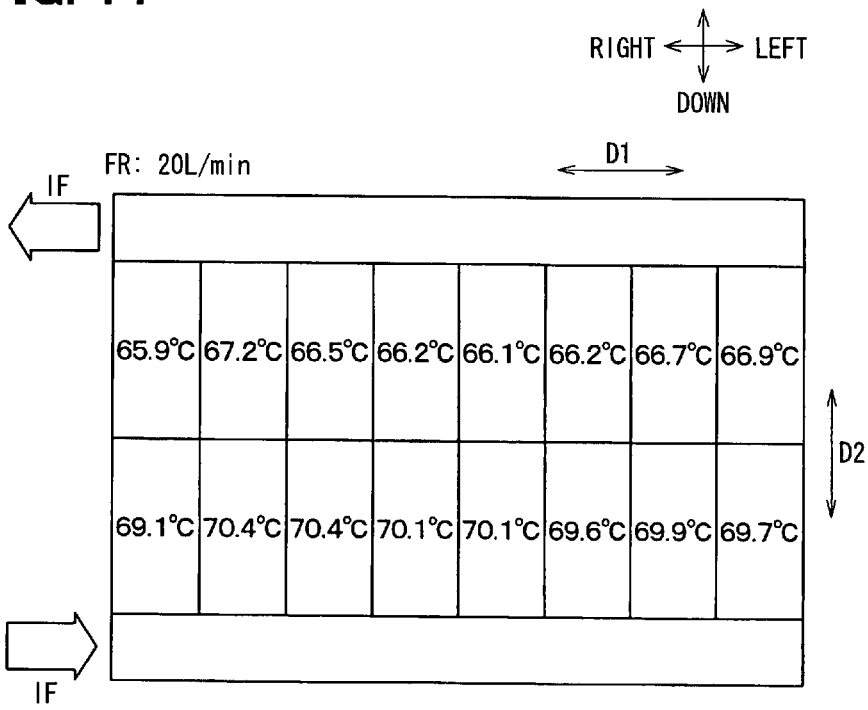
FIG. 14 is a diagram showing a detected temperature of air discharged from each section of the heater core, when the flow rate is 20 L/min, according to the first embodiment.

FIGS. 12 to 14 are examination results for showing detected temperatures of the air having passed through the core part 24. The core part 24 is divided into sixteen sections, and the temperature of the air passed through each section (hereafter, the discharged air temperature) is measured. Specifically, the core part 24 is divided into two sections in the tube longitudinal direction D2, such as in the up and down direction, and further divided into eight sections in the tube stacking direction D1, such as in the left and right direction.

It is examined in a condition that the temperature of the suction air is 5° C.; the internal fluid temperature is 88° C.; the density of LLC is 50%, and the volume of the air is 300 $m^3$/h. FIG. 12 shows the result when the flow rate FR is 6 L/min. FIG. 13 shows the result when the flow rate FR is 10 L/min. FIG. 14 shows the result when the flow rate FR is 20 L/min.

In FIGS. 12 to 14, the difference of the discharged air temperatures with respect to the tube stacking direction D1 is the largest when the flow rate FR is 6 L/min. However, even when the flow rate FR is 6 L/min, the difference of the discharged air temperatures is sufficiently reduced.

Specifically, when the flow rate FR is 6 L/min, the minimum discharge air temperatures of the lower sections is in a range between 65.9° C. and 67.2° C., as shown in FIG. 12. Thus, in the lower sections, the difference of the discharge air temperatures in the tube stacking direction D1 is reduced to 1.3° C. Also, the minimum discharge air temperatures of the upper sections is in a range between 58.2° C. and 61.2° C., as shown in FIG. 12. Thus, in the upper sections, the difference of the discharge air temperatures in the tube stacking direction D1 is reduced to 3.0° C.

In this embodiment, the volume differences of the internal fluid into the tubes 22U are reduced by partly covering the openings of the inlet tubes 22*a* of the tubes 22U by the plate member 34. Therefore, the volumes of the internal fluid into the tubes 22U are uniform by the simple structure without requiring high accuracy for assembling.

The main wall 35 of the plate member 34 is arranged along the inlet ends 22*a* of the tubes 22U, and a cross-sectional area of the plate member 34 is reduced as small as possible. Therefore, it is less likely that the pressure loss of the flow of the internal fluid will increase due to collision with the main wall 35.

In this embodiment, when the flow rate FR is 6 L/min, the resistance of the internal fluid to flow is 0.85 kPa. When the flow rate FR is 10 L/min, the resistance of the internal fluid to flow is 2.1 kPa. When the flow rate FR is 20 L/min, the resistance of the internal fluid to flow is 7.1 kPa.

In the comparative example, on the other hand, the resistance of the internal fluid to flow is 0.79 kPa, when the flow rate FR is 6 L/min. The resistance of the internal fluid to flow is 1.9 kPa, when the flow rate FR is 10 L/min. The resistance of the internal fluid to flow is 6.8 kPa, when the flow rate FR is 20 L/min.

Accordingly, the flow resistance only slightly increases due to the plate member 34. Therefore, the pressure loss will not be largely increased due to the plate member 34.

Further, the plate member 34 is easily assembled. The plate member 34 is assembled by simply inserting into the inlet tank 25 after the components of the heater core 13, other than the plate member 34, are integrally brazed. Also, the heater core 13 will not need a specific shape or structure in association with the plate member 34.

Accordingly, the volumes of the internal fluid between the tubes 22 are uniform with low costs, and hence the heater core 13 is practical in use.

Second Embodiment

A second embodiment will be described with reference to FIGS. 15 to 17. In this embodiment, the plate member 34 is preliminarily fixed to the tank main body 31 before the heater core 13 is integrally brazed.

Figure 15:
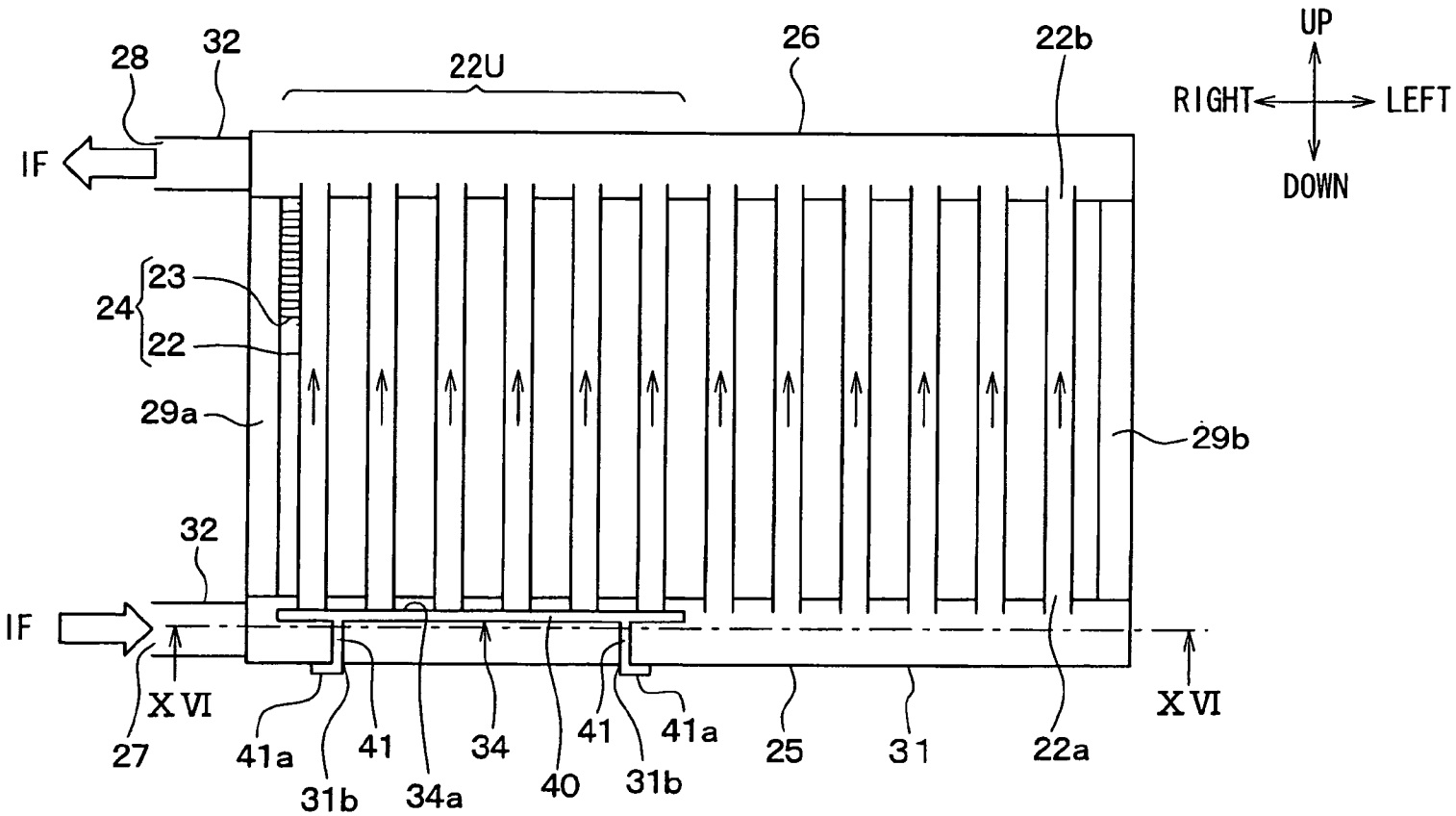
FIG. 15 is a schematic view of a heater core according to a second embodiment of the present invention.

As shown in FIG. 15, the plate member 34 is formed by shaping a metal plate such as aluminum plate. The plate member 34 has a main wall 40 and leg portions 41 for fixing the main wall 40 to the tank main body 31. The main wall 40 has a generally plate shape and extends in the tube stacking direction D1 with a predetermined width. The wall surface 34*a* is provided by a first surface of the main wall 40, which faces the inlet ends 22*a* of the tubes 22U.

Figure 16:
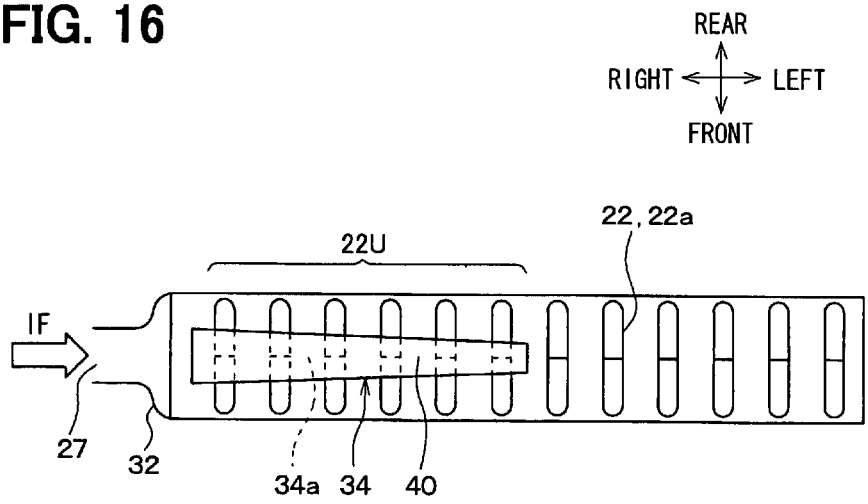
FIG. 16 is a schematic cross-sectional view of the heater core taken along a line XVI-XVI in FIG. 15.

As shown in FIG. 16, the main wall 40 has a tapered shape such that the width thereof reduces from its first end (left end in FIG. 16) that is adjacent to the inlet port 27 toward its second end (right end in FIG. 16) that is farther away than the first end with respect to the inlet port 27. In this embodiment, the main wall 40 does not have shapes corresponding to the narrow portion 35*a* and the wide portion 35*b* of the main wall 35 of the first embodiment.

The tank main body 31 is formed with insertion holes 31*b*. The leg portions 41 project toward the insertion holes 31*b* of the tank main body 31 from the main wall 40.

Next, a procedure for assembling the plate member 34 to the inlet tank 25 will be described. First, ends 41*a* of the leg portions 41 are inserted into the insertion holes 31*b* from the inner side of the inlet tank 25, so that the ends 41*a* project from an outer surface of the tank main body 31 for predetermined dimensions. Then, the ends 41*a* are bent along the outer surface of the tank main body 31. As such, the plate member 34 is preliminarily fixed to the tank main body 31.

Thereafter, the components of the heater core 13 are integrally brazed. At this time, the leg portions 41 of the plate member 34 are also brazed with the tank main body 31. Thus, the plate member 34 is assembled with the heater core 13.

Figure 17:
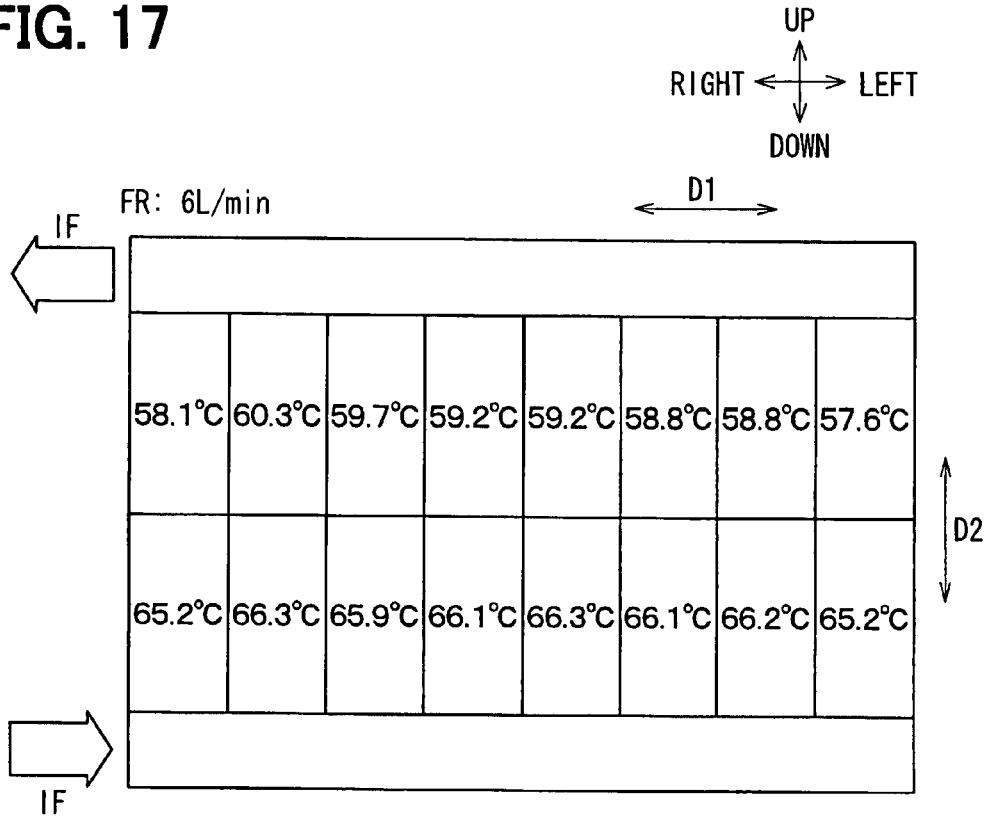
FIG. 17 is a diagram showing a detected temperature of air discharged from each section of the heater core according to the second embodiment.

FIG. 17 shows the examination result of the discharge air temperatures of the heater core 13 of the second embodiment. It is examined in the same examination condition as the examination of FIG. 12.

As shown in FIG. 17, even when the plate member 34 is constructed as described in the above, the volume of the internal fluid is substantially uniform between the tubes 22. Thus, the difference of the discharge air temperatures in the tube stacking direction D1 is reduced.

In the second embodiment, the main wall 40 does not have the shape corresponding to the narrow portion 35*a* of the first embodiment. Therefore, the volume of the internal fluid flowing into the upstream three tubes X is reduced, as compared with the first embodiment. As such, in FIG. 17, the discharge air temperatures of the sections that are the closest to the inlet port 27 (leftmost sections in FIG. 17) are lower than those of the first embodiment shown in FIG. 12.

In the second embodiment, the shape of the plate member 34 is simplified as compared with the shape of the plate member 34 of the first embodiment. Thus, the increase of the resistance of the internal fluid to flow due to the plate member 34 is further reduced. Specifically, in this embodiment, the resistance of the internal fluid to flow is 0.81 kPa when the flow rate FR is 6 L/min. Thus, under the same condition in use, the resistance of the internal fluid of the second embodiment is lower than that of the first embodiment (0.85 kPa).

Since the plate member 34 is preliminarily fixed to the tank main body 31, it is not necessary to insert the plate member 34 into the inlet tank 25 through the inlet port 27 as the first embodiment. Therefore, the shape and dimensions of the plate member 34 are not limited in association with the shape and dimensions of the inlet port 27. Namely, flexibility of designing the plate member 34 improves. Because the shape and dimensions of the plate member 34 are more optimized, the volume of the internal fluid is further effectively uniform between the tubes 22.

Third Embodiment

Figure 18A:
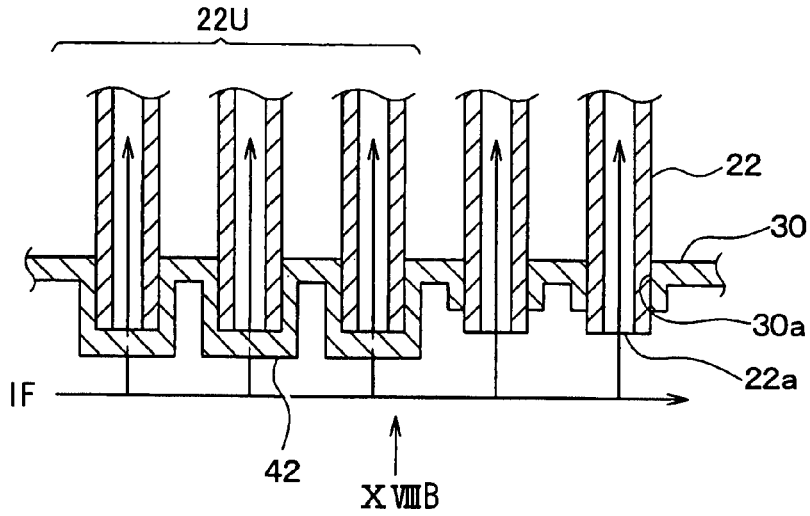
FIG. 18A is a schematic cross-sectional view of a portion of a heater core according to a third embodiment of the present invention.
Figure 18B:
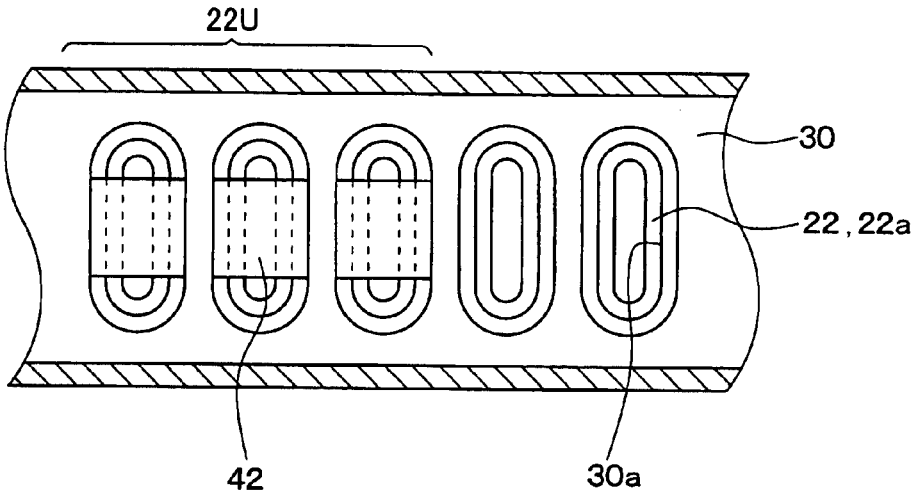
FIG. 18B is a schematic cross-sectional view of the portion of the heater core viewed along an arrow XVIIIB in FIG. 18A.

A third embodiment will be described with reference to FIGS. 18A and 18B. In the third embodiment, the heater core 13 does not have the plate member 34. In place of the plate member 34, the core plate 30 is formed with embossed portions 42 as the cover member.

The embossed portions 42 project from peripheral portions of the tubes insertion holes 30*a*, which have burring shapes, toward the inside of the inlet tank 25. Each of the embossed portions 42 has a shape along the inlet end 22*a* of the tube 22U, which projects inside of the inlet tank 25. The embossed portion 42 partly overlaps the tube insertion hole 30*a*, as shown in FIG. 18B.

As such, the opening of the inlet end 22*a* of each tube 22U is partly covered by the embossed portion 42. Accordingly, similar to the first embodiment, the volume of the internal fluid in each tube 22 is uniform and the difference of the discharge air temperatures in the tube stacking direction D1 is reduced.

The embossed portions 42 do not have portions that increase the resistance of the internal fluid to flow in the inlet tank 25 as the leg portions 34 of the plate member 34. Therefore, the resistance of the internal fluid to flow is reduced, as compared with the first embodiment. With this, the pressure loss of the internal fluid is reduced.

Since the embossed portions 42 are integrally formed with the core plate 30, the number of assembling steps reduces. Thus, costs for manufacturing the heater core 13 reduces.

Fourth Embodiment

A fourth embodiment will be described with reference to FIG. 19. In the fourth embodiment, the plate member 34 is disposed in the outlet tank 26, instead of the inlet tank 25.

Figure 19:
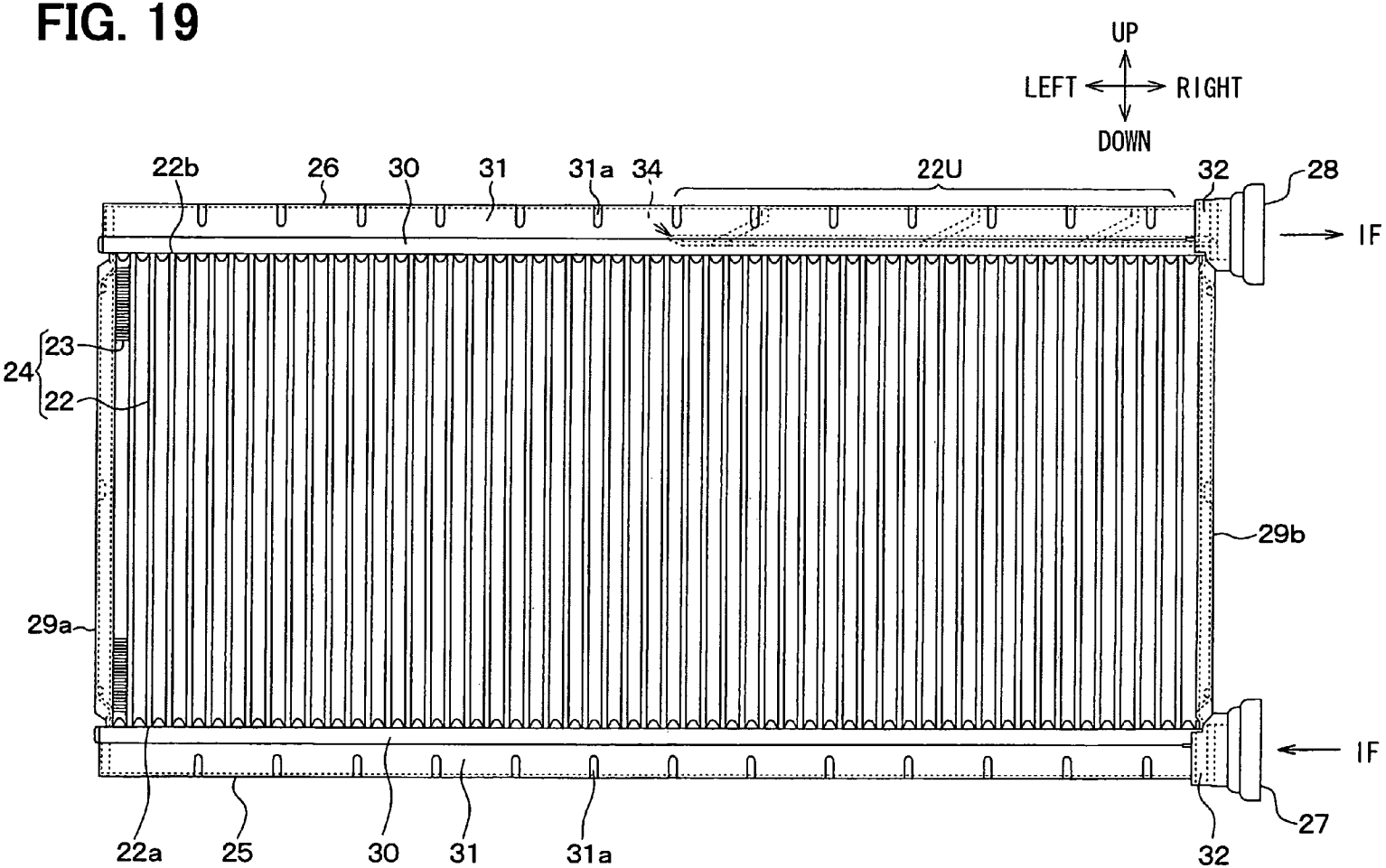
FIG. 19 is a plan view of a heater core according to a fourth embodiment of the present invention.

As shown in FIG. 19, the plate member 34 is disposed symmetric with the arrangement in the first embodiment with respect to the up and down direction. The plate member 34 partly covers the openings of the outlet ends 22*b* of the tubes 22U. Also in this case, the plate member 34 disposed in the outlet tank 26 serves as the cover member.

The plate member 34 is disposed such that the narrow portion 35*a* partly covers the openings of the outlet ends 22*b* of the three tubes X of the tubes 22U, which are closer to the outlet port 28, and the wide portion 35*b* partly covers the openings of the outlet ends 22*b* of the remaining tubes Y of the tubes 22U. Thus, the covered area of the opening of each outlet end 22*b* of the three tubes X is smaller than that of the opening of each outlet end 22*b* of the remaining tubes Y of the tubes 22U.

Also, the widths a1, a2, a3 of the main wall 35 are smaller than the diameter of the opening of the outlet port 28. Therefore, the plate member 34 can be inserted into the outlet tank 26 through the outlet port 28 after the components of the heater core 13 other than the plate member 34 are integrally brazed.

Figure 20:
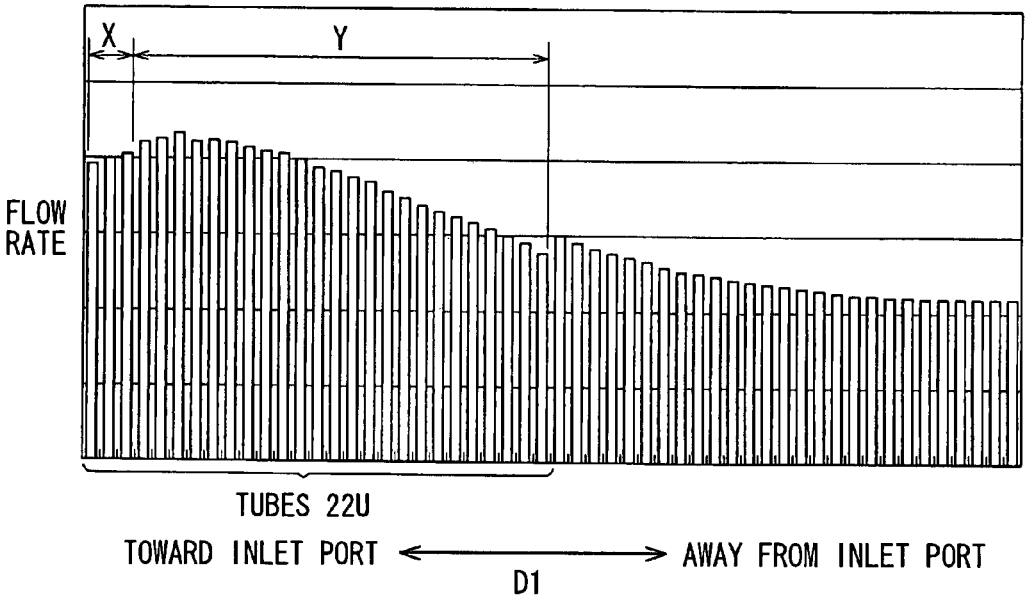
FIG. 20 is a graph showing a flow rate of an internal fluid flowing into each tube of the heater core according to the fourth embodiment of the present invention.

FIG. 20 shows a result of numerical analysis of the volume of the internal fluid flowing into each tube 22. It is analyzed in the same condition as the analysis shown in FIG. 10.

Since the openings of the outlet ends 22*b* of the tubes 22U are partly covered by the plate member 34, the volume of the internal fluid flowing into the tubes 22U reduces. As a result, the volume of the internal fluid flowing into the tubes 22 other than the tubes 22U increases. That is, the volume of the internal fluid flowing into the tubes 22 that are farther away from the outlet port 28 increases. Accordingly, the volume of the internal fluid is uniform between the tubes 22.

Fifth Embodiment

Figure 21:
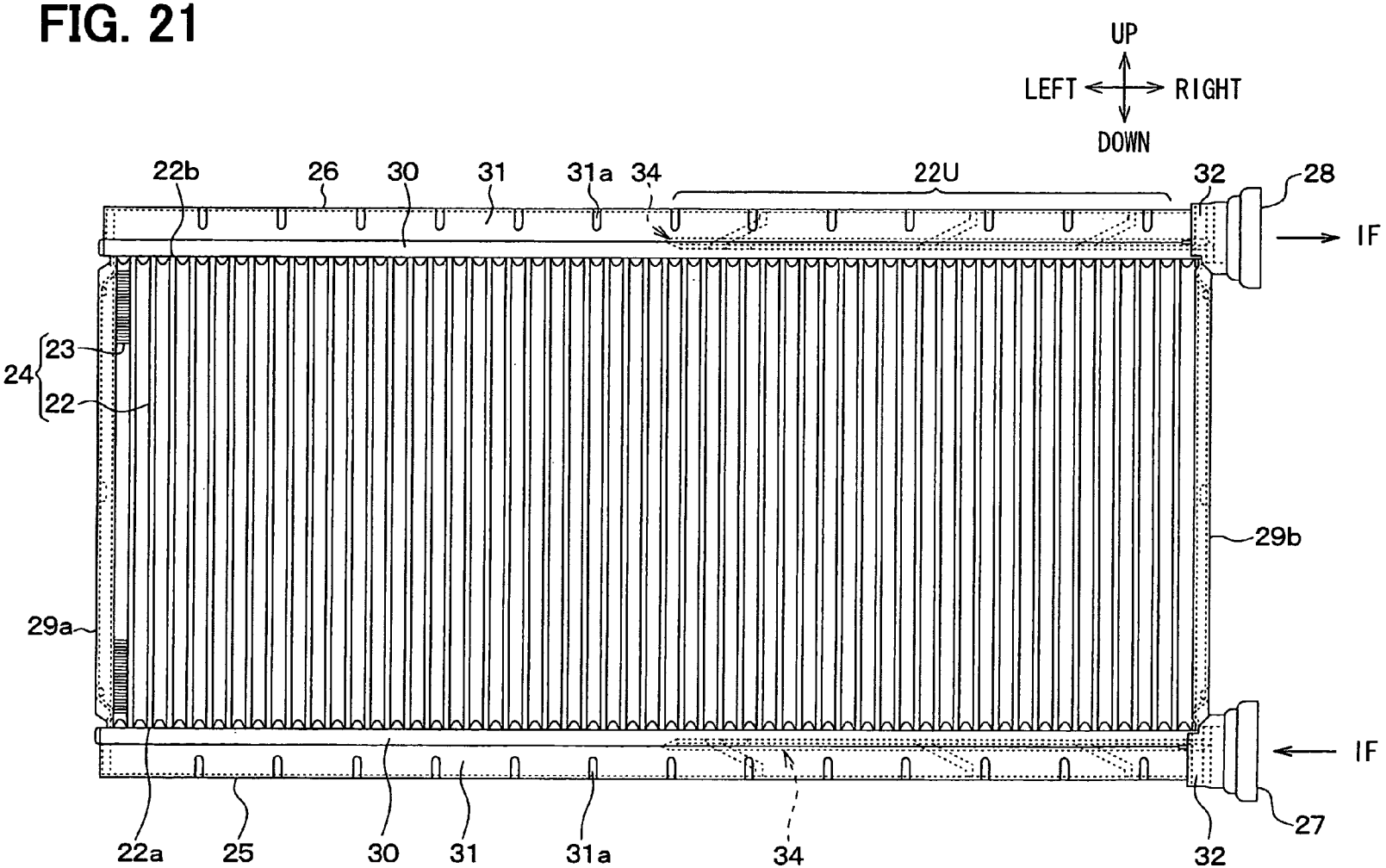
FIG. 21 is a plan view of a heater core according to a fifth embodiment of the present invention.

A fifth embodiment will be described with reference to FIGS. 21 and 22. In the fifth embodiment, the heater core 13 is constructed as combination of the first and fourth embodiments. Namely, the plate members 34 are provided in both of the inlet tank 25 and the outlet tank 26, as shown in FIG. 21.

Figure 22:
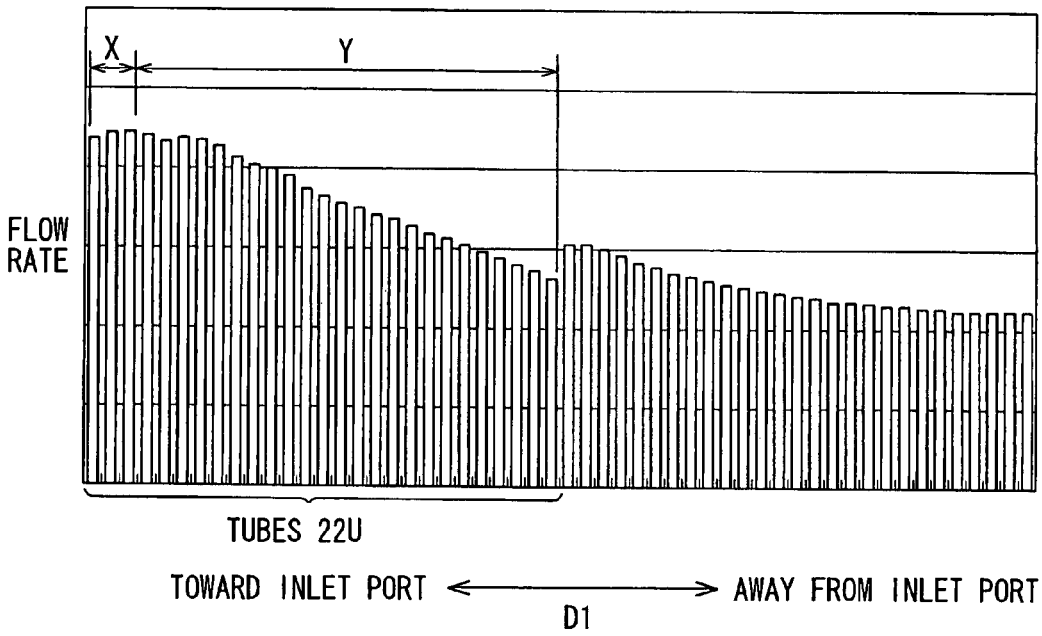
FIG. 22 is a graph showing a flow rate of an internal fluid flowing in each tube of the heater core according to the fifth embodiment.

FIG. 22 shows a result of numerical analysis of the volume of the internal fluid flowing into each tube 22 in the heater core 13 of the fifth embodiment. It is analyzed in the same condition as the analyses of the first and fourth embodiments shown in FIGS. 10 and 20. The plate members 34 are disposed such that the narrow portions 35*a* partly covers the openings of the inlet and outlet ends 22*a*, 22*b* of the three tubes X of the tubes 22U and the wide portion 35*b* partly covers the openings of the inlet and outlet ends 22*a*, 22*b* of the remaining tubes Y of the tubes 22U.

As shown in FIG. 22, even when the plate members 34 are provided in both of the inlet and outlet tanks 25, 26, the similar effects as the first and fourth embodiments will be provided.

Other Embodiments

In the above embodiments, the heat exchanger is exemplary employed to the heater core of the vehicular air conditioning apparatus. However, the heat exchanger to which the present invention is applied may be other heat exchangers such as a radiator for cooling an engine cooling water and a refrigerant condenser for a vehicular air conditioning apparatus. Further, the heat exchanger may be any other heat exchangers other than the heat exchangers for vehicles.

In the second embodiment, the plate member 34 is disposed in the inlet tank 25. However, the plate member 34 of the second embodiment may be disposed in the outlet tank 26 or both of the inlet and outlet tanks 25, 26.

In the third embodiment, the embossed portions 42 are integrally formed with the core plate 30 of the inlet tank 25. Further, the embossed portions 42 may be integrally formed with the core plate 30 of the outlet tank 26, or the core plates 30 of both of the inlet and outlet tanks 25, 26.

In the above embodiments, the inlet port 27 and the outlet port 28 are located on the same side with respect to the tube stacking direction D1. However, it is not always necessary that the inlet port 27 and the outlet port 28 are located on the same side with respect to the tube stacking direction D1. That is, the cover member may be employed to a heat exchanger having the different structure as the above embodiments. For example, the inlet tank 25 and the outlet tank 26 may be located on the same side with respect to the tube stacking direction D2.

Additional advantages and modifications will readily occur to those skilled in the art. The invention in its broader term is therefore not limited to the specific details, representative apparatus, and illustrative examples shown and described.

What is claimed is:

1. A heat exchanger comprising:

a plurality of tubes stacked in a tube stacking direction;

an inlet tank coupled to the tubes and having an inlet port on an end thereof;

an outlet tank coupled to the tubes and having an outlet port on an end thereof, the end being on a same side as the inlet port with respect to the tube stacking direction; and a cover member disposed in at least one of the inlet tank and the outlet tank, wherein the cover member partly covers openings of ends of predetermined tubes of the plurality of the tubes, the predetermined tubes being located adjacent to at least one of the inlet port and the outlet port with respect to the tube stacking direction;

the cover member includes a main wall extending in a direction parallel to the tube stacking direction with a predetermined width, the main wall has a wall surface that is perpendicular to a longitudinal direction of the tubes, and the openings of the ends of the predetermined tubes are partly covered by the wall surface;

the main wall includes a first wall portion and a second wall portion, the second wall portion being disposed farther away than the first wall portion with respect to at least one of the inlet port and the outlet port in the tube stacking direction, and the second wall portion having a width greater than a width of the first wall portion, the widths of the first and second wall portions being defined by dimensions in a direction perpendicular to the tube stacking direction.

2. The heat exchanger according to claim 1, wherein the second wall portion has a tapered shape such that the width of the second wall portion reduces with a distance from at least one of the inlet port and the outlet port in the tube stacking direction.

3. A heat exchanger comprising:

a plurality of tubes stacked in a tube stacking direction;

an inlet tank coupled to the tubes and having an inlet port on an end thereof;

an outlet tank coupled to the tubes and having an outlet port on an end thereof, the end being on a same side as the inlet port with respect to the tube stacking direction; and a cover member disposed in at least one of the inlet tank and the outlet tank, wherein the cover member contacts of ends of a predetermined number of the plurality of tubes so that the cover member partly covers openings of the ends of the predetermined number of the plurality of the tubes, the predetermined number of the plurality of tubes being less than a total number of the plurality of tubes, the predetermined number of the plurality of tubes being located adjacent to at least one of the inlet port and the outlet port with respect to the tube stacking direction;

the cover member includes a main wall extending in a direction parallel to the tube stacking direction with a predetermined width, the main wall has a wall surface that is perpendicular to a longitudinal direction of the tubes, the openings of the ends of the predetermined number of the plurality of tubes are partly covered by the wall surface;

at least one of the inlet tank and the outlet tank, in which the cover member is disposed, has a tubular shape extending in a direction parallel to the tube stacking direction and has a tank inner surface that is opposed to the ends of the tubes, the cover member further includes leg portions extending from the main wall toward the tank inner surface, and ends of the leg portions are in contact with the tank inner surface.

4. The heat exchanger according to claim 3, wherein the cover member is disposed in the inlet tank and partly covers the openings of the ends of the predetermined number of the plurality of tubes inside of the inlet tank.

5. The heat exchanger according to claim 3, wherein the cover member is disposed in the inlet tank, the inlet port of the inlet tank defines an opening that opens in a direction parallel to the tube stacking direction, and the predetermined width of the main wall of the cover member is smaller than a dimension of the opening of the inlet port.

6. The heat exchanger according to claim 5, wherein each of the leg portions is inclined relative to the longitudinal direction of the tubes such that the end of the leg portion is located closer to the inlet port than a base portion of the leg portion, the base portion connecting to the main wall.

7. The heat exchanger according to claim 6, wherein the inlet tank has a tank main body and a core plate, the tank main body and the core plate are coupled to each other and provide a tank space therebetween, the core plate has tube insertion holes in which the ends of the tubes are inserted, the tank main body has a semi-cylindrical shape and includes embossed portion projecting into the tank space, and the end of each leg portion includes a bent portion extending in a direction parallel to the longitudinal direction of the tubes, and the bent portion is engaged with a corresponding one of the embossed portions in a direction parallel to the tube stacking direction.

8. The heat exchanger according to claim 7, wherein the main wall of the cover member has an engagement portion on an end adjacent to the inlet port of the inlet tank, and the engagement portion projects toward the core plate and is engaged with an end surface of the core plate in a direction parallel to the tube stacking direction, the end surface of the core plate being adjacent to the inlet port.

9. The heat exchanger according to claim 5, wherein the inlet tank includes a tank main body and a core plate, the tank main body and the core plate are coupled to each other and provide a tank space therebetween, the core plate has tube insertion holes and the ends of the tubes are inserted in the tube insertion holes, the main wall of the cover member includes an engagement portion on an end adjacent to the inlet port, and the engagement portion projects toward the core plate and is engaged with an end surface of the core plate in a direction parallel to the tube stacking direction, the end surface of the core plate being adjacent to the inlet port.

10. The heat exchanger according to claim 5, wherein the main wall of the cover member has an inclined surface on an end that is opposite to the inlet port of the inlet tank, and the inclined surface is inclined such that a distance between the inclined surface and the ends of the tubes increases with a distance from the inlet port of the inlet tank.

11. The heat exchanger according to claim 3, wherein the cover member is disposed in the outlet tank, the outlet port of the outlet tank defines an opening that opens in a direction parallel to the tube stacking direction, and the predetermined width of the main wall of the cover member is smaller than a dimension of the opening of the outlet port.

12. The heat exchanger according to claim 11, wherein each of the leg portions is inclined relative to the longitudinal direction of the tubes such that the end of the leg portion is located closer to the outlet port than a base portion of the leg portion, the base portion connecting to the main wall.

13. The heat exchanger according to claim 12, wherein the outlet tank has a tank main body and a core plate, the tank main body and the core plate are coupled to each other to provide a tank space therebetween, the core plate has tube insertion holes in which the ends of the tubes are inserted, the tank main body has a semi-cylindrical shape and includes embossed portion projecting into the tank space, and the end of each leg portion includes a bent portion extending in a direction parallel to the longitudinal direction of the tubes, and the bent portion is engaged with a corresponding one of the embossed portions in a direction parallel to the tube stacking direction.

14. The heat exchanger according to claim 13, wherein the main wall of the cover member has an engagement portion on an end adjacent to the outlet port of the outlet tank, and the engagement portion projects toward the core plate and is engaged with an end surface of the core plate in a direction parallel to the tube stacking direction, the end surface of the core plate being adjacent to the outlet port.

15. The heat exchanger according to claim 11, wherein the outlet tank includes a tank main body and a core plate, the tank main body and the core plate are coupled to each other to provide a tank space therebetween, the core plate has tube insertion holes and the ends of the tubes are inserted in the tube insertion holes, the main wall of the cover member includes an engagement portion on an end adjacent to the outlet port, and the engagement portion projects toward the core plate and is engaged with an end surface of the core plate in a direction parallel to the tube stacking direction, the end surface of the core plate being adjacent to the outlet port.

16. The heat exchanger according to claim 11, wherein the main wall of the cover member has an inclined surface on an end that is opposite to the port of the header tank, and the inclined surface is inclined such that a distance between the inclined surface and the ends of the tubes increases with a distance from the outlet port of the outlet tank.

* * * * *